US010174754B2

(12) United States Patent
Ophardt et al.

(10) Patent No.: US 10,174,754 B2
(45) Date of Patent: Jan. 8, 2019

(54) DISPLACEMENT PUMP

(71) Applicant: OP-Hygiene IP GmbH, Niederbipp (CH)

(72) Inventors: Heiner Ophardt, Arisdorf (CH); Andrew Jones, Smithville (CA); Zhenchun (Tony) Shi, Hamilton (CA)

(73) Assignee: OP-Hygiene IP GmbH, Niederbipp (CH)

( * ) Notice: Subject to any disclaimer, the term of this patent is extended or adjusted under 35 U.S.C. 154(b) by 460 days.

(21) Appl. No.: 14/874,144

(22) Filed: Oct. 2, 2015

(65) Prior Publication Data

US 2016/0097386 A1 Apr. 7, 2016

(30) Foreign Application Priority Data

Oct. 3, 2014 (CA) ..... 2866055

(51) Int. Cl.

| | |
|---|---|
| ***A47K 5/12*** | (2006.01) |
| ***F04B 53/10*** | (2006.01) |
| ***B05B 11/00*** | (2006.01) |
| ***F04B 43/02*** | (2006.01) |
| ***F04B 49/12*** | (2006.01) |
| ***F04B 53/16*** | (2006.01) |

(52) U.S. Cl.

CPC ..... *F04B 53/102* (2013.01); *A47K 5/1208* (2013.01); *B05B 11/007* (2013.01); *B05B 11/0054* (2013.01); *B05B 11/303* (2013.01); *B05B 11/3064* (2013.01); *B05B 11/3069* (2013.01); *F04B 43/02* (2013.01); *F04B 49/12* (2013.01); *F04B 53/1092* (2013.01); *F04B 53/16* (2013.01); *B05B 11/3035* (2013.01)

(58) Field of Classification Search

CPC ..... A47K 5/12; A47K 5/1204; A47K 5/1207; A47K 5/1208; A47K 5/1209; F04B 53/102; F04B 43/02; F04B 49/12; F04B 53/1092; F04B 53/16; B05B 11/0054; B05B 11/007; B05B 11/303; B05B 11/3064; B05B 11/3069; B05B 11/3035

USPC ..... 222/207, 180–181.3

See application file for complete search history.

(56) References Cited

U.S. PATENT DOCUMENTS

| | | | | |
|---|---|---|---|---|
| 2,275,972 | A * | 3/1942 | Maloney | B05B 11/3032 222/207 |
| 3,715,060 | A | 2/1973 | Benson | |
| 3,952,924 | A | 4/1976 | Benson | |
| 4,168,020 | A | 9/1979 | Benson | |
| 4,330,071 | A | 5/1982 | Ohlson | |
| 5,165,577 | A | 11/1992 | Ophardt | |

(Continued)

FOREIGN PATENT DOCUMENTS

| | | |
|---|---|---|
| CA | 2837774 | 6/2015 |
| DE | 10011717 | 9/2001 |
| GB | 2150226 | 6/1985 |

*Primary Examiner* — Patrick M Buechner

(74) *Attorney, Agent, or Firm* — Thorpe North and Western

(57) ABSTRACT

A valve assembly with a valve member coaxially received within a valve casing and interacts with the casing to provide a one-way inlet valve at one end of the valve casing and a one-way outlet valve at the other end of the casing with an annular compartment therebetween adapted to be coupled to a variable volume compartment and thereby together provide a simplified construction for valving components of a fluid pump.

19 Claims, 22 Drawing Sheets

(56) References Cited

U.S. PATENT DOCUMENTS 5,282,552 A * 2/1994 Ophardt ..... A47K 5/1204 222/181.2
5,638,989 A * 6/1997 Ophardt ..... A47K 5/1207 222/105
5,676,277 A 10/1997 Ophardt
5,975,360 A 11/1999 Ophardt
6,409,050 B1 6/2002 Ophardt et al.
7,178,692 B2 2/2007 Ophardt
7,267,251 B2 9/2007 Ophardt
7,303,099 B2 12/2007 Ophardt
RE40,319 E 5/2008 Ophardt et al.
7,556,178 B2 7/2009 Ophardt
7,770,874 B2 8/2010 Ophardt
8,272,539 B2 9/2012 Ophardt et al.
8,360,286 B2 1/2013 Shi et al.
8,365,965 B2 2/2013 Ophardt
8,474,664 B2 7/2013 Ophardt et al.
8,919,611 B2 12/2014 Ophardt et al.
8,944,292 B2 2/2015 Ophardt et al.
8,976,031 B2 3/2015 Ophardt
2002/0074359 A1 6/2002 Weber
2002/0148912 A1* 10/2002 Ophardt ..... A47K 5/1207 239/428.5
2006/0175354 A1* 8/2006 Ophardt ..... A47K 5/1202 222/188
2008/0029556 A1* 2/2008 Chen ..... A47K 5/1207 222/541.6
2009/0184136 A1* 7/2009 Ciavarella ..... A47K 5/1208 222/190
2010/0140879 A1* 6/2010 Ophardt ..... F04B 1/0408 277/435
2012/0132668 A1* 5/2012 Ophardt ..... A47K 5/1207 222/1
2015/0266657 A1* 9/2015 Corney ..... B65D 47/06 222/478
2017/0027391 A1* 2/2017 Jones ..... B05B 11/0016

* cited by examiner

DISPLACEMENT PUMP

SCOPE OF THE INVENTION

This invention relates to pumps and, more particularly, to displacement pumps, preferably diaphragm pumps.

BACKGROUND OF THE INVENTION

Many pumps for fluid dispensers are known. A difficulty of many known fluid pumps is that they comprise a number of components and often, for example, have a one-way inlet valve which is formed as a separate component from a one-way outlet valve.

Many known pump arrangements typically have an actuator to move elements of the pump and a discharge outlet out of which fluid is to be discharged. Many such known pump arrangements require a specific relationship between the location of the actuator and its relative direction of motion and the location and relative direction of a discharge outlet which is disadvantageous in not permitting easy adaptation of the pump to fit into relatively confined spaces such as may be found within some hand cleaning fluid dispensers.

Many art pumps are known to be coupled to an opening in a fluid containing bottle, however, with the pump inserted into the bottle with an inlet from which fluid is drawn from the bottle disposed at a location within the bottle that has the disadvantage that not all of the fluid from the bottle may be drawn from the bottle by the pump.

SUMMARY OF THE INVENTION

To at least partially overcome these disadvantages of known fluid dispensers, the present invention provides an improved valve assembly for providing controlled one-way fluid flow into and one-way fluid flow out of a variable volume compartment. To overcome other disadvantages, the present invention also provides a valve assembly with a valve member coaxially received within a valve casing and interacts with the casing to provide a one-way inlet valve at one end of the valve casing and a one-way outlet valve at the other end of the casing with an annular compartment therebetween adapted to be coupled to a variable volume compartment and thereby together provide a simplified construction for valving components of a fluid pump.

The fluid pump may comprise many different types of pumps without limitation, however, is preferably selected from a displacement pump, more preferably, a diaphragm pump, and a piston pump.

In a preferred embodiment, the fluid pump is a displacement pump including a movable member defining at least in part a variable volume compartment. Movement of the movable member changes the volume of the variable volume compartment to alternately draw fluid into the fluid pump and discharge fluid from the fluid pump.

The present invention in one embodiment provides a displacement pump comprising a movable member defining at least a portion of the periphery of a variable volume compartment. Movement of the movable member changes the volume of the variable volume compartment. The pump includes a tubular valve casing elongate along a casing axis and defining a value chamber therein. The valve chamber has an inner wall circular in cross-section along the axis, an inlet end and an outlet end. A valve member is coaxially located within the valve chamber. The valve member comprises a stem extending axially within the valve chamber. An inlet disc extends radially outwardly from the stem to a distal end in engagement with wall. The inlet disc engages the wall to prevent fluid flow axially therepast in a direction from the outlet end towards the inlet end. The inlet disc is resiliently deflectable to be deflected from engaging the wall to permit fluid flow axially therepast in a direction from the inlet end towards the outlet end. An outlet disc extends radially outwardly from the stem to a distal end in engagement with wall. The outlet disc engages the wall to prevent fluid flow axially therepast in a direction from the outlet end towards the inlet end. The outlet disc is resiliently deflectable to be deflected from engaging the wall to permit fluid flow axially therepast in a direction from the inlet end towards the outlet end. The inlet disc is spaced axially away from the outlet end from the outlet disc. The outlet disc is spaced axially away from the inlet end from the inlet disc. An inlet is provided into the valve chamber between the inlet end and the inlet disc. An outlet is provided from the valve chamber between the outlet end and the outlet disc. A fluid transfer port is provided in communication with the diaphragm chamber and open into the valve chamber in between the inlet disc and the outlet disc.

Preferably, movement of the movable member changes the volume of the visible volume compartment thereby drawing the fluid into the variable volume compartment via the transfer port from the valve chamber in an inlet stroke and discharging the fluid from the variable volume compartment via the transfer port into the valve chamber in a discharge stroke. On drawing the fluid into the diaphragm chamber via the transfer port from the valve chamber a vacuum is created within the valve chamber between the inner disc and the outer disc which acts on the inner disc to deflect the inner disc from engaging the wall permitting the fluid to be drawn inwardly from the inlet opening past the inner disc. On discharging the fluid from the diaphragm chamber via the transfer port into the valve chamber pressure is created within the valve chamber between the inner disc and the outer disc which acts on the outer disc to deflect the outer disc from engaging the wall permitting the fluid to be discharged outwardly past the outer disc to the outlet.

Preferably, the valve casing is open at the inlet end which may form the inlet or the valve stem may carry a first sealing disc which engages the valve casing to close the inlet end of the valve chamber. Preferably, the valve casing is open at the outlet end which may form the outlet or the valve stem carries a sealing disc which engages the valve casing to close the outlet end of valve chamber. The valve casing may be closed at the inlet end by an end wall. The valve member may engage the valve casing to axially locate the valve member relative the valve casing, for example, against relative axial sliding or for limited axial sliding.

Preferably, the valve member is injection molded as a unitary element from resilient material. Also preferably, the valve casing is injection molded as a unitary element. The valve member and the valve casing interact to provide a one-way inlet valve and a one-way outlet valve yet may be conveniently made from but two injection molded unitary elements.

In one aspect, the present invention provides a pump comprising:

- a variable volume compartment defined between a chamber-forming body and a movable member movable relative to the chamber-forming body wherein movement of the movable member changes a volume of the variable volume compartment between a first volume and a second volume different than the first volume,
- a tubular valve casing elongate along a casing axis and defining a valve chamber therein, the valve chamber having an inner wall circular in cross-section along the axis, an inlet end and an outlet end, a valve member coaxially located within the valve chamber, the valve member comprising a stem extending axially within the valve chamber, an inlet disc extending radially outwardly from the stem to a distal end in engagement with wall, the inlet disc engaging the wall to prevent fluid flow axially therepast in a direction from the outlet end towards the inlet end, the inlet disc being resiliently deflectable to be deflected from engaging the wall to permit fluid flow axially therepast in a direction from the inlet end towards the outlet end, an outlet disc extending radially outwardly from the stem to a distal end in engagement with wall, the outlet disc engaging the wall to prevent fluid flow axially therepast in a direction from the outlet end towards the inlet end, the outlet disc being resiliently deflectable to be deflected from engaging the wall to permit fluid flow axially therepast in a direction from the inlet end towards the outlet end, the inlet disc spaced axially away from the outlet end from the outlet disc, the outlet disc spaced axially away from the inlet end from the inlet disc, an inlet into the valve chamber spaced axially away from the outlet end from the inlet disc, an outlet from the valve chamber spaced axially away from the inlet end from the outlet disc, a fluid transfer port in communication with the variable volume compartment and open into the valve chamber in between the inlet disc and the outlet disc.

In another aspect, the present invention provides a diaphragm pump comprising:

a resilient diaphragm member defining at least a portion of the periphery of a variable volume diaphragm compartment, wherein movement of the diaphragm member changes the volume of the diaphragm compartment, a tubular valve casing elongate along a casing axis and defining a value chamber therein, the valve chamber having an inner wall circular in cross-section along the axis, an inlet end and an outlet end, a valve member coaxially located within the valve chamber, the valve member comprising a stem extending axially within the valve chamber, an inlet disc extending radially outwardly from the stem to a distal end in engagement with wall, the inlet disc engaging the wall to prevent fluid flow axially therepast in a direction from the outlet end towards the inlet end, the inlet disc being resiliently deflectable to be deflected from engaging the wall to permit fluid flow axially therepast in a direction from the inlet end towards the outlet end, an outlet disc extending radially outwardly from the stem to a distal end in engagement with wall, the outlet disc engaging the wall to prevent fluid flow axially therepast in a direction from the outlet end towards the inlet end, the outlet disc being resiliently deflectable to be deflected from engaging the wall to permit fluid flow axially therepast in a direction from the inlet end towards the outlet end, the inlet disc spaced axially away from the outlet end from the outlet disc, the outlet disc spaced axially away from the inlet end from the inlet disc, an inlet into the valve chamber spaced axially away from the outlet end from the inlet disc, an outlet from the valve chamber spaced axially away from the inlet end from the outlet disc, a fluid transfer port in communication with the diaphragm compartment and open into the valve chamber in between the inlet disc and the outlet disc.

BRIEF DESCRIPTION OF THE DRAWINGS

Further objects and advantages of the invention will appear from the following description taken together with the accompanying drawings in which.

DETAILED DESCRIPTION OF THE DRAWINGS

Figure 1:
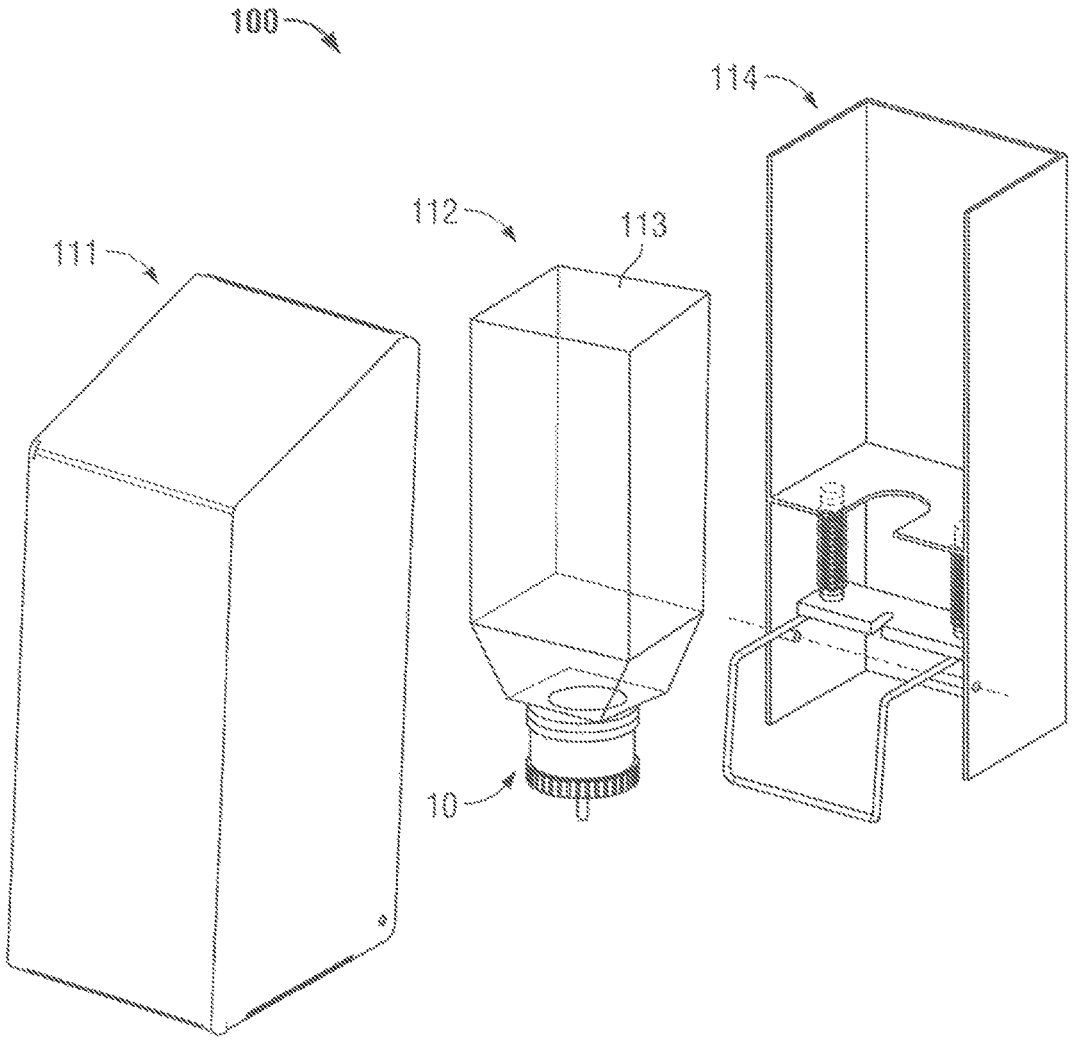
FIG. 1 is a perspective view of a first preferred embodiment of a dispenser in accordance with the invention.

Reference is made first to FIG. 1 which shows a dispenser 100 in accordance with a preferred embodiment of the invention. The dispenser 100 comprises a cover 111, a reservoir cartridge 112, and a housing 114. The cover 111 is coupled to the housing 114 preferably for pivoting movement between an open position and closed position to permit the reservoir cartridge 112 to be removably coupled to the housing 114 in a compartment defined between the cover 111 and the housing 114 as, for example, in a manner similar to that disclosed in U.S. Pat. No. 8,272,540 to Ophardt et al, issued Sep. 25, 2012, the disclosure of which is incorporated herein by reference.

The reservoir cartridge 112 comprises a bottle 113 and a pump assembly 10. The bottle 113 has a chamber 116 for holding fluid 118 as, for example, liquid soap which is to be dispensed. An outlet 120 is provided through a 119 neck of the bottle 113 carried on a lowermost wall of the chamber 116, across which is located the pump assembly 10 which, amongst other things, dispenses the fluid 118 outwardly therethrough. Preferably, the reservoir cartridge 112 is disposable once the supply of fluid 118 is exhausted. The pump assembly 10 includes a body 12 and a diaphragm member 14. The diaphragm member 14 is coupled to the body 12 for movement between an extended position and a refracted position to dispense material. The body 12 has an annular collar 39 for sealed engagement with the neck 119 of the bottle 113. A radially inwardly extending annular support slotway 101 is provided circumferentially about the neck 119.

Figure 2:
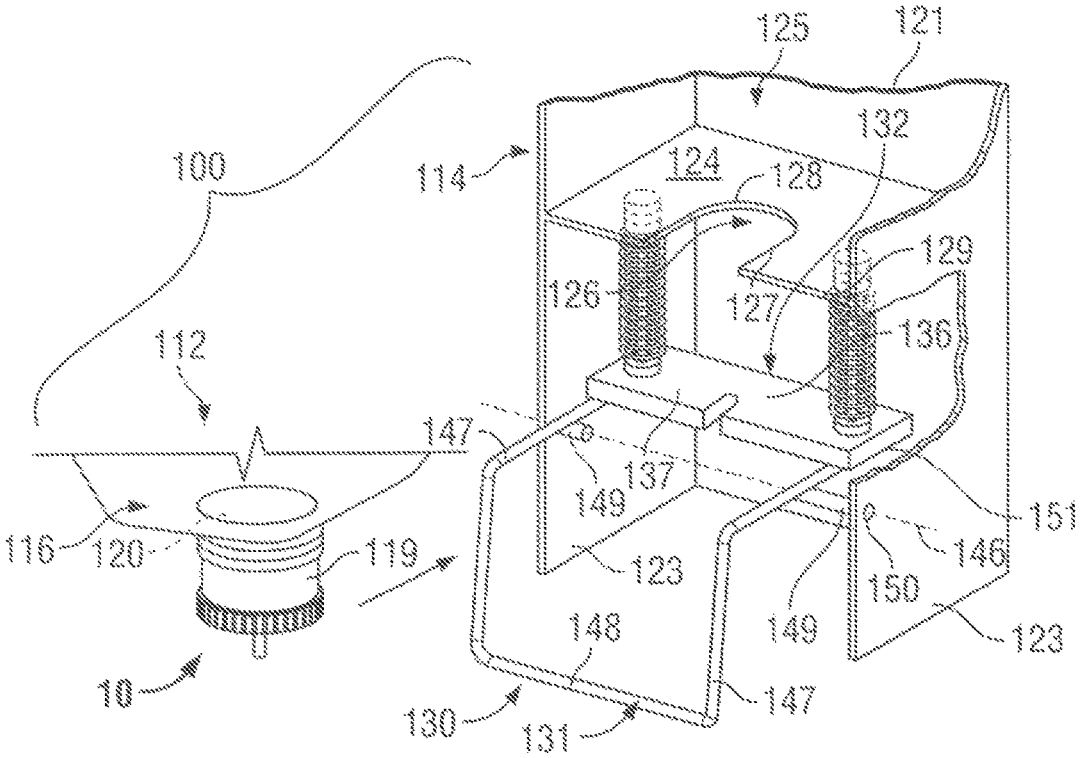
FIG. 2 is an exploded partial perspective view of the housing and a reservoir cartridge of the dispenser of FIG. 1 illustrating the reservoir cartridge ready for insertion by relative horizontal movement.

FIG. 2 shows the housing 114 in an open configuration ready for insertion of the reservoir cartridge 112. The housing 114 includes a backplate 121 typically adapted for permanent attachment to a wall. A pair of side walls 123 extends vertically forwardly from each side of the backplate 121. A support flange 124 is provided extending horizontally between the side walls 123 so as to define a cavity 125 above the flange 124 between the side walls 123 and the backplate 121 to receive the reservoir cartridge 112.

The flange 124 has an opening 126 vertically therethrough in the form of a U-shaped slot 127 closed at a rear blind end 128 and open forwardly to the front edge 129 of the flange 124.

An actuator assembly 130 is provided on the housing 114 movable relative to the housing. The actuator assembly 130 includes notably a pivoting lever 131 and an actuator plate 132 mounted to the housing 114 to be vertically slidable. Pivoting of the lever 131 moves the vertically slidable actuator plate 132 linearly on a pair of vertically extending guide rods 133 against the bias of springs 134 disposed about the guide rods 133. The actuator plate 132 has an upwardly directed upper surface 136. A slot 137 extends vertically through the actuator plate 132. The slot 137 opens forwardly and is closed at a rear end.

The two parallel spaced locating rods 133 are fixedly secured at their upper ends 141 to flange 124 and extend downwardly to their lower ends 142 to which respective retaining ferrules 143 are secured. The actuator plate 132 has a pair of cylindrical bores through which the rods 133 pass. The actuator plate 132 is disposed on the rods 133 above the ferrules 143.

Springs 134 are provided about each of the locating rods 133. The springs 134 have an upper end which engage the flange 124 and a lower end which engage an upper surface of actuator plate 132 to resiliently bias the actuator plate 132 away from the flange 124 downwardly toward a fully extended position shown in FIGS. 1 to 3.

The actuator assembly 130 includes the lever 131 which is pivotally connected to the housing 114 for pivoting about a horizontal axis 146. The lever 130 is U-shaped having a pair of side arms 147 connected at their front by a horizontal connecting bight 148. A pair of horizontal stub axles 149 extend laterally outwardly from the side arms 147 and are received in holes 150 through the side walls 123 to journal the lever 131 to the housing 114 for pivoting about the axis 146.

A rear end 151 of the lever 131 engages a lower surface of the actuator plate 132. Manual urging of the bight 148 of the lever 131 rearwardly by a user moves the actuator plate 132 upwardly against the bias of the springs 133 from the extended position shown in FIG. 2 to a retracted position not shown. On release of the lever 131, the force of the springs 133 returns the actuator plate 132 to the extended position.

As seen in FIGS. 3 to 7, the pump assembly 10 includes the body 12 and a diaphragm member 14. The body 12 has an axially extending discharge tube 15 which extends outwardly from the body 12 to a fluid discharge outlet 16.

The opening 126 of the flange 124 is positioned to permit the reservoir cartridge 112 to be readily coupled to and removed from the housing. From a position as seen in FIG. 1, the reservoir cartridge 112 is slid rearwardly inward into the housing 114 with the flange 124 engaged in the support slotway 101 on the neck 119, the discharge tube 15 to slide rearwardly into the slot 137 and the diaphragm member 14 to be located above the actuator plate 132. The flange 124 engages the support slotway 101 on the neck 119 of the bottle 113 to support the reservoir cartridge 112 in a fluid dispensing position with the flange 124 preventing axial sliding movement of the body 12 and the bottle 113 as the dispenser 100 is used. The U-shape of the opening 126 of the flange 124 assists in guiding the reservoir cartridge 112 as it is inserted into and removed horizontally from the housing 114. Preferably, the flange 124 engages the slotway 101 in a friction fit manner to resist sliding.

Figure 3:
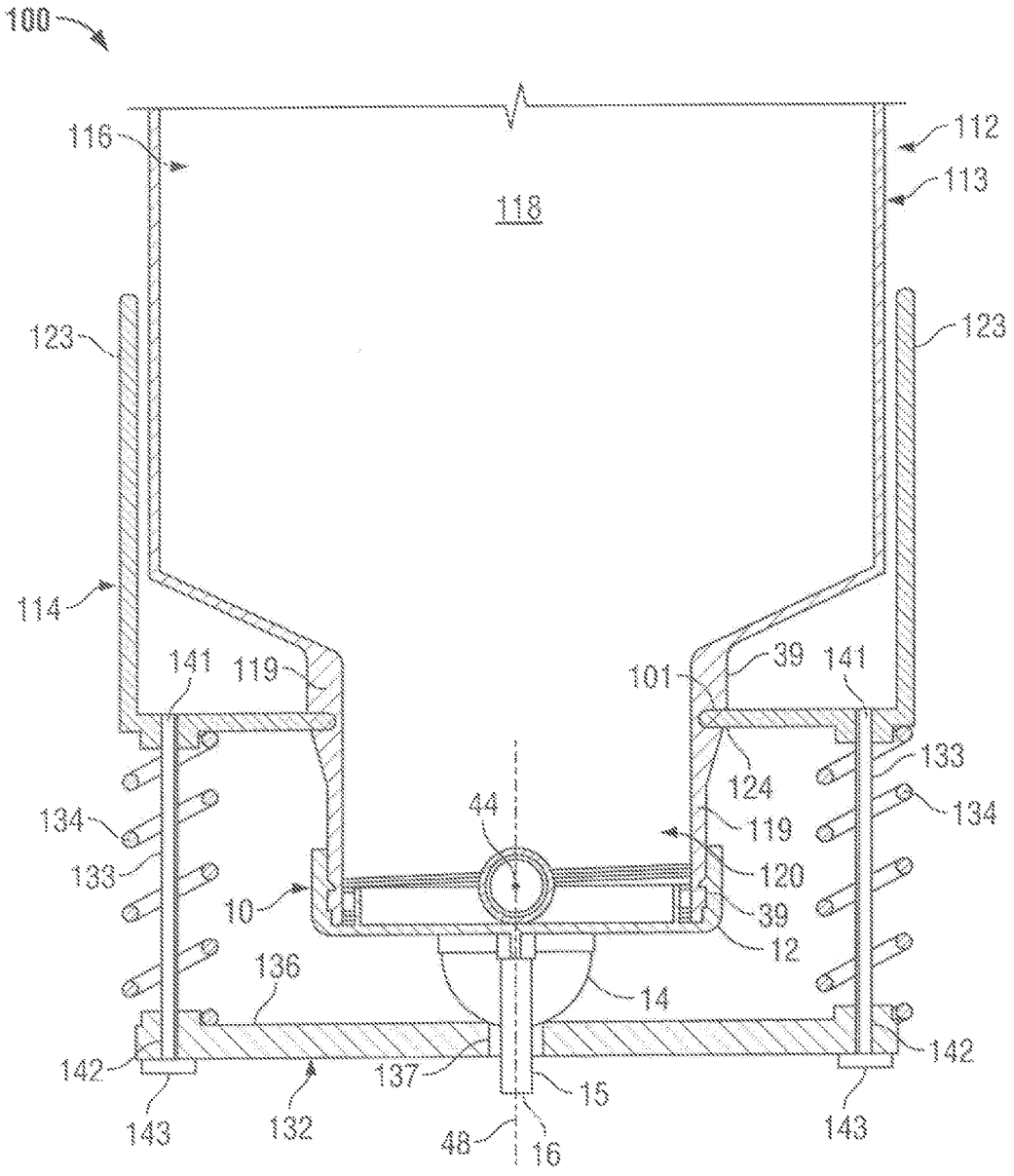
FIG. 3 is a partial cross-sectional front view of the housing and reservoir cartridge of FIG. 1 in a coupled orientation with an actuator assembly of the housing and a diaphragm member of the reservoir cartridge in a fully extended rest position.
Figure 4:
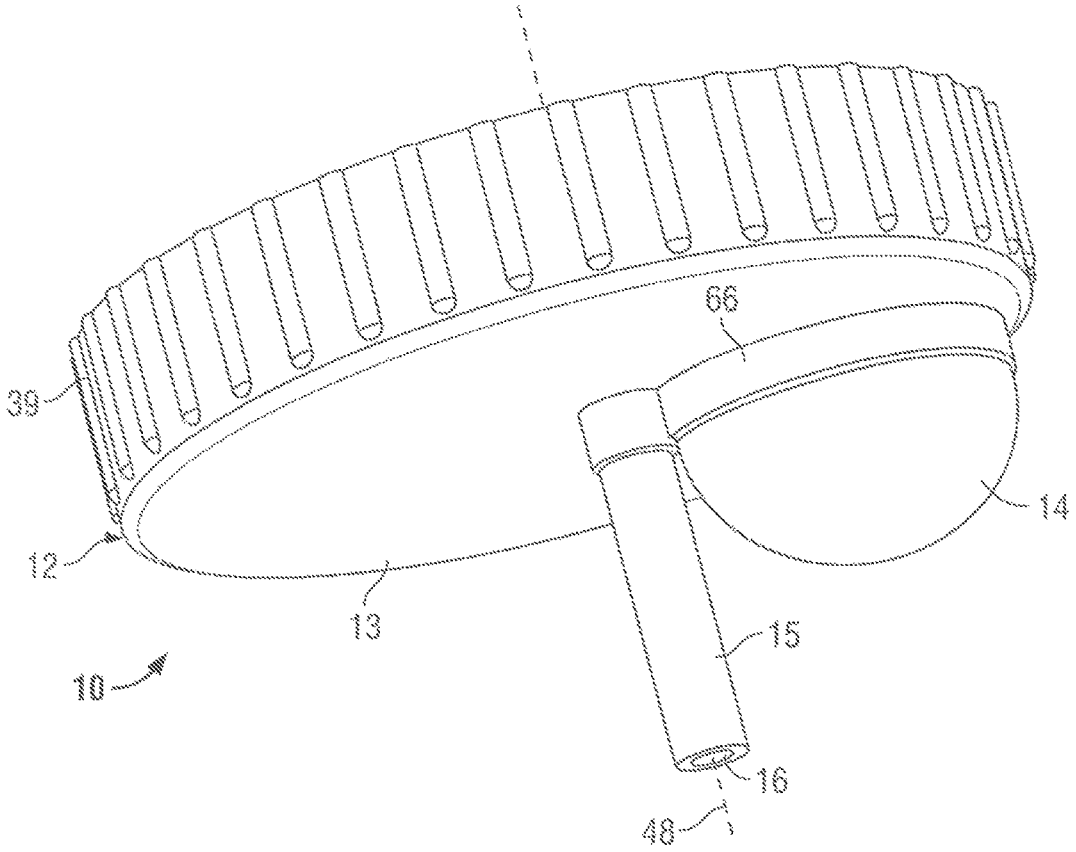
FIG. 4 is an assembled pictorial view showing the bottom of a pump assembly in accordance with a first embodiment of the present invention.
Figure 5:
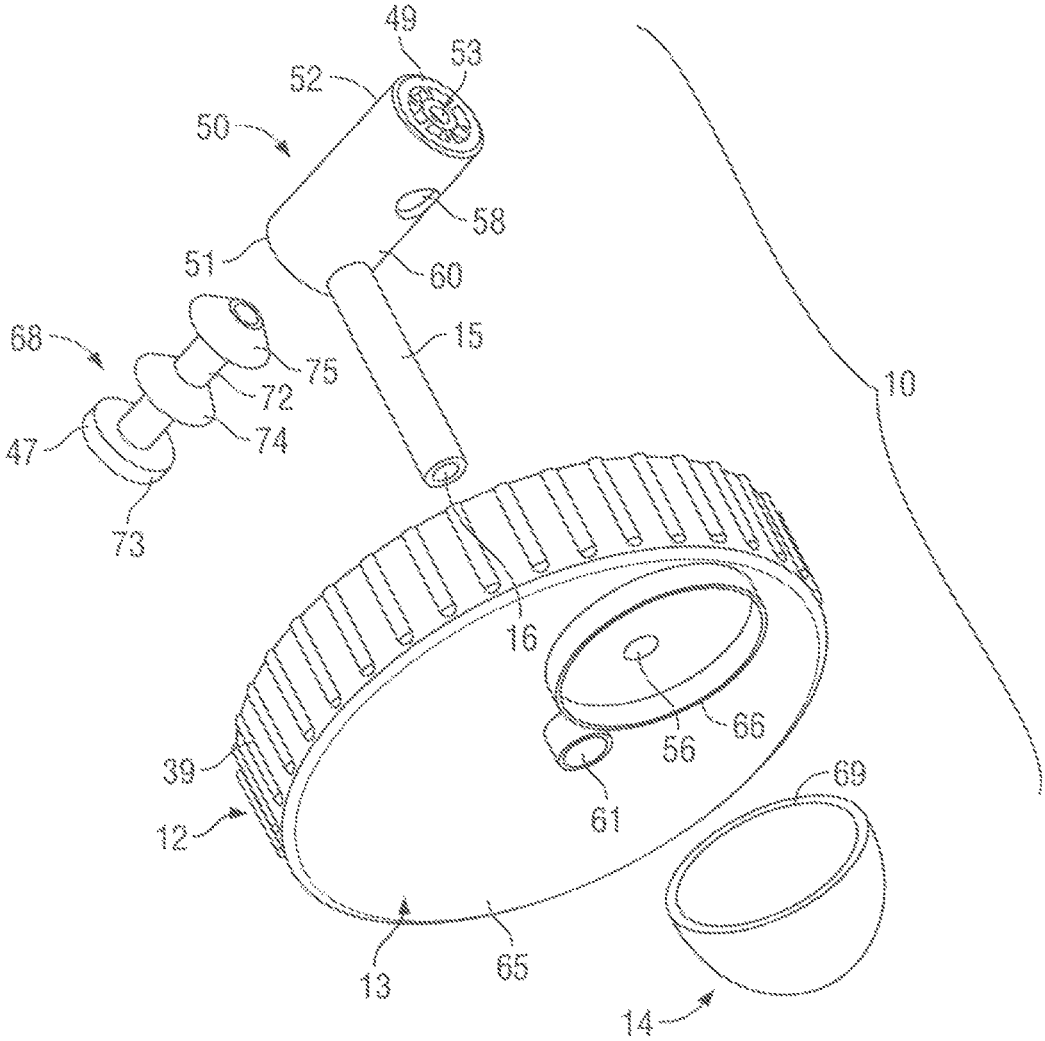
FIG. 5 is an exploded pictorial view showing the bottom of the pump assembly shown in FIG. 4.
Figure 6:
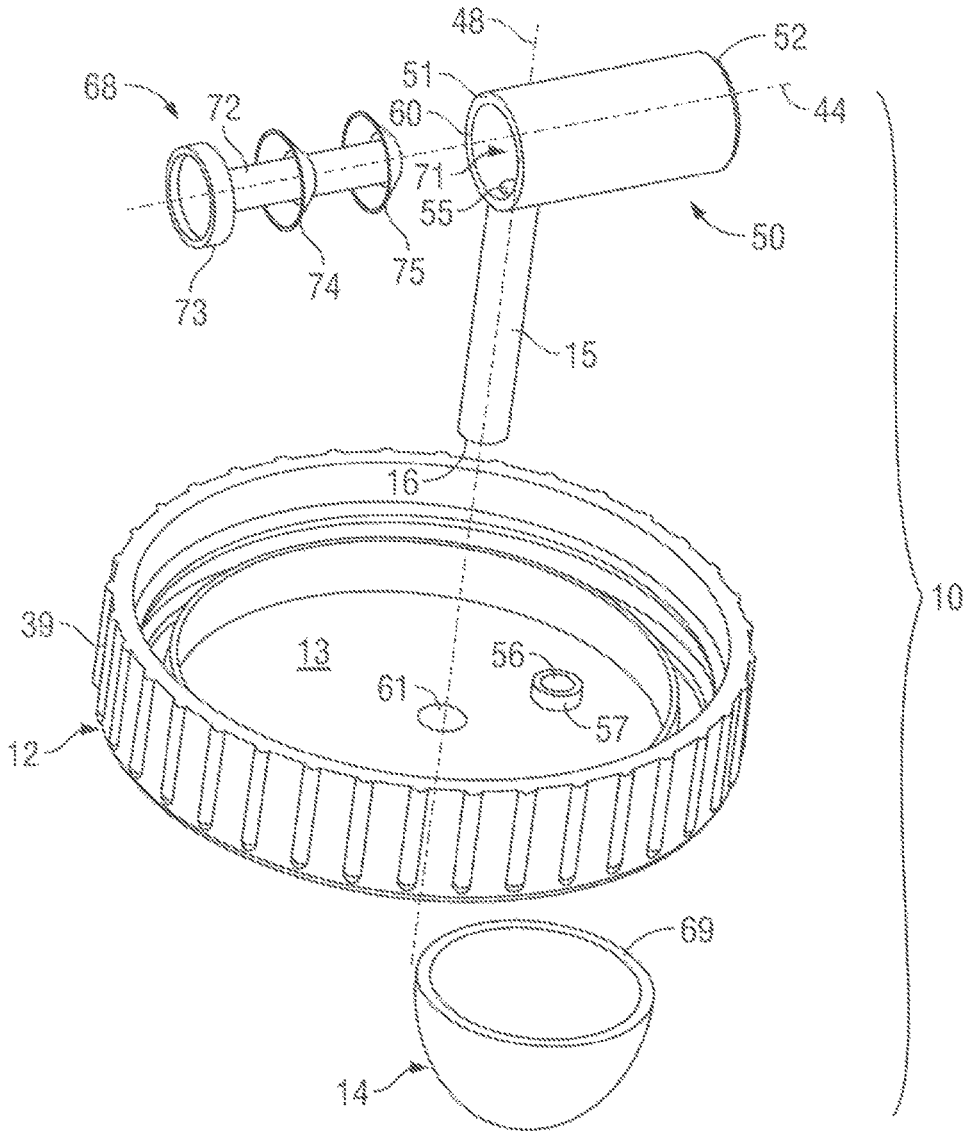
FIG. 6 is an exploded pictorial view showing the top of the pump assembly shown in FIG. 4.
Figure 7:
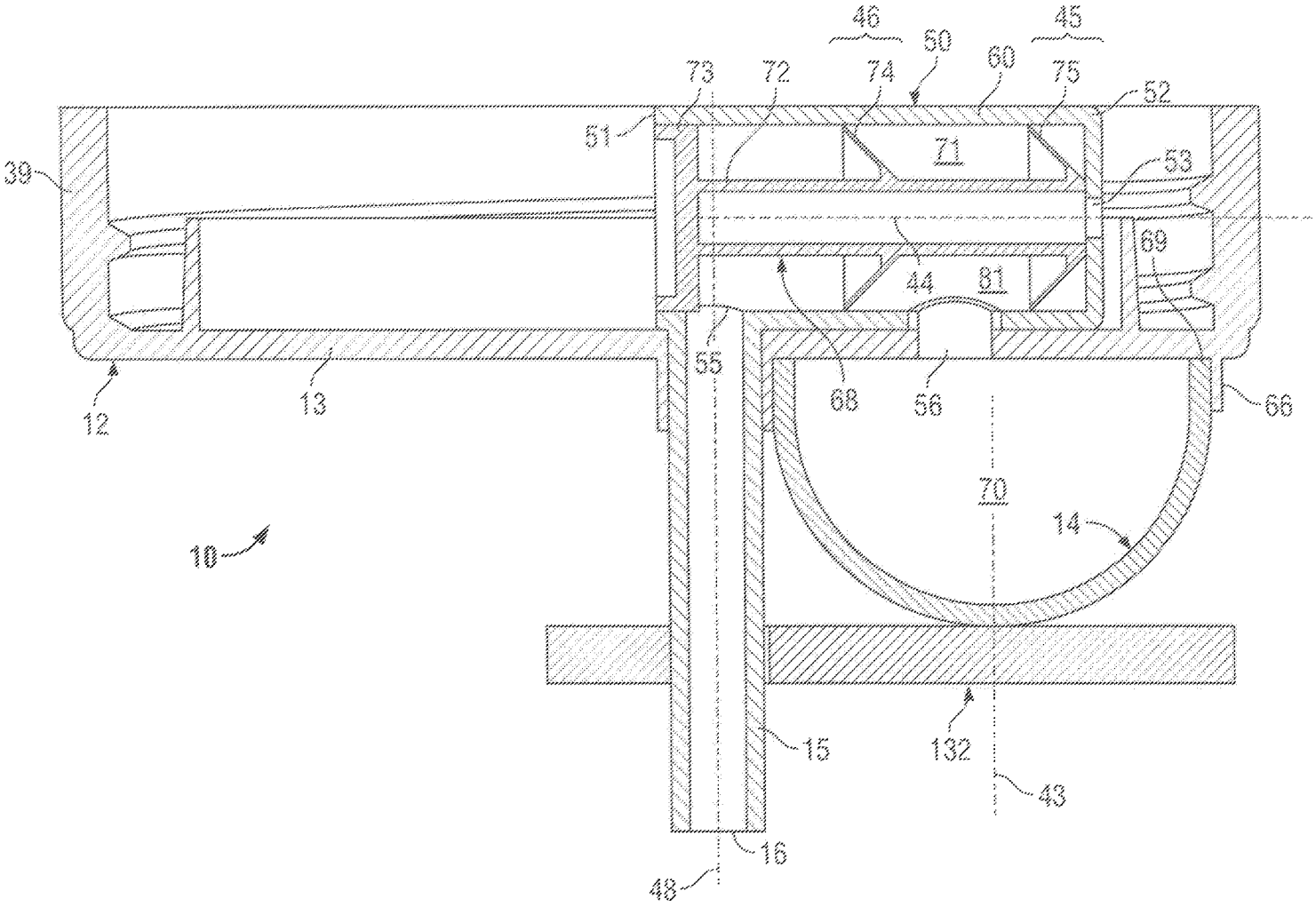
FIG. 7 is a cross-sectional side view of the pump assembly of FIG. 4 in an extended position.
Figure 8:
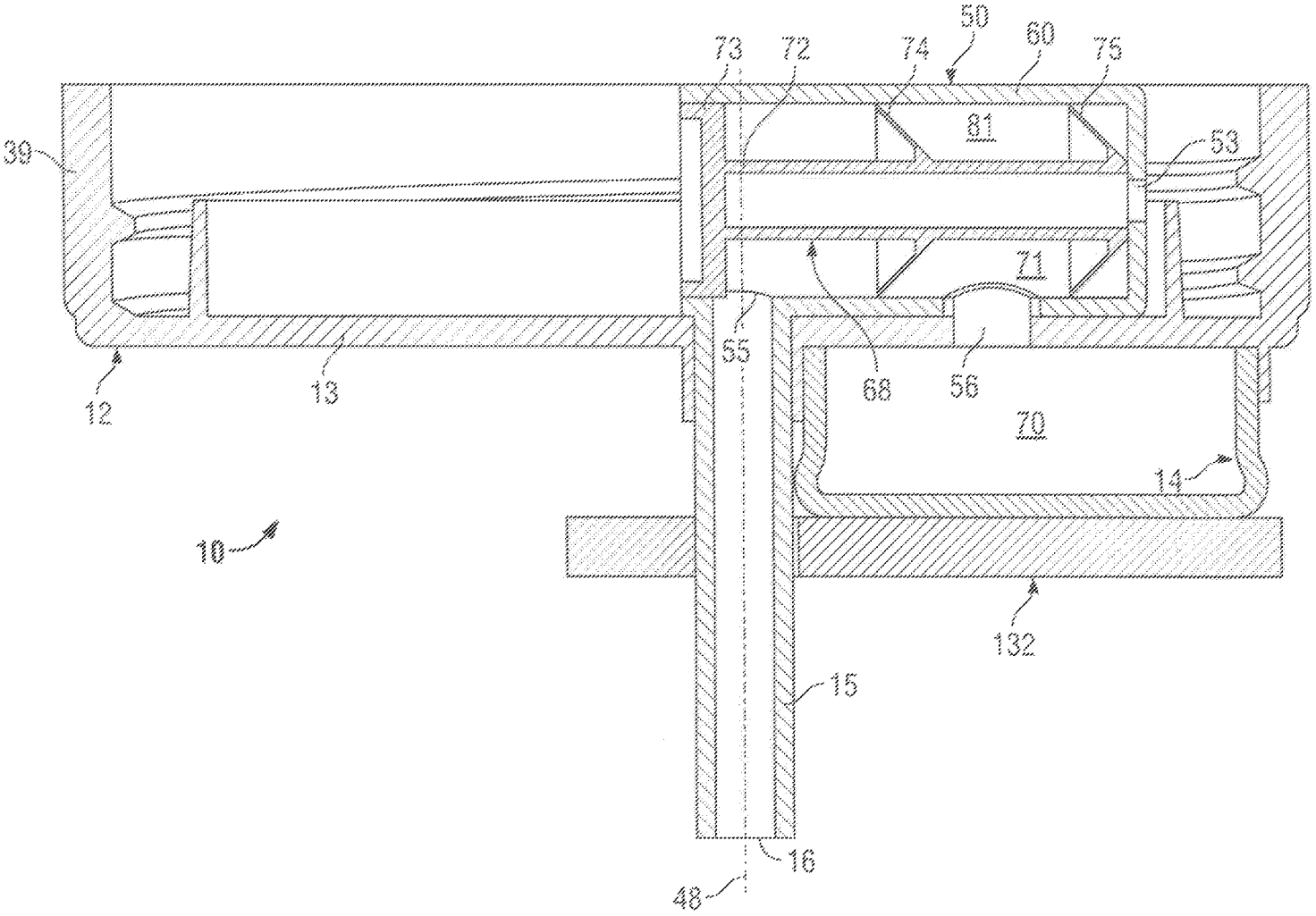
FIG. 8 is a cross-sectional view the same as FIG. 6 but showing a retracted condition.

As seen in a coupled orientation in FIG. 3 with the diaphragm member 14 engaged by the upper surface 136 of the actuator 132, reciprocal movement of the actuator plate 132 between the extended position and the refracted position results in corresponding movement of the diaphragm member 14 relative the body 12 between an extended position as shown in FIG. 7 and a retracted position as shown in FIG. 8 to dispense material from the reservoir cartridge 112 out the discharge outlet 16.

FIGS. 4 to 8 best illustrate the first embodiment of the pump assembly 10 in accordance with the present invention as a diaphragm liquid pump. The pump assembly 10 includes the body 12 with a radially extending base 13 from which the annular collar 39 extends axially inwardly about a collar axis 48 and presents interior threaded surfaces for threaded sealed engagement as with the neck of the bottle 113.

The pump assembly 10 includes a cylindrical tubular casing 50 coaxial about a casing axis 44. The casing 50 is open at an outlet end 51 and closed at an inlet end 52 by an inlet end wall 49 with liquid inlet openings 53 axially through the end wall. The tubular casing 50 has the liquid discharge tube 15 attached to it. The discharge tube 15 is a cylindrical tube which extends radially from an outlet opening 55 inside the tubular casing 50 proximate the outlet end 51 of the tubular casing 50 to the liquid discharge outlet 16.

The base 13 has a pump transfer opening 56 therethrough including a short stub transfer tube 57 which extends axially inwardly from the base 13. A circular transfer port 58 is provided through a cylindrical side wall 60 of the tubular casing 50. The transfer port 58 is sealably engaged upon the transfer tube 57. A discharge tube opening 61 is provided axially through the base 13. The tubular casing 50 is fixedly secured to the base 13 with the liquid discharge tube 15 extending outwardly from the base 13 coaxial to the collar axis 48 of the annular collar 39.

An axially outer face 65 of the base 13 carries an axially outwardly extending cylindrical flange 66. The diaphragm member 14 is a substantially semi-spherical flexible elastomeric membrane that has an open end 69 sealably engaged within the cylindrical flange 66 axially outwardly of the base 13 so as to define a variable volume diaphragm compartment 70 open through the pump transfer opening 56 to a pump chamber 71 inside the tubular casing 50.

Within the tubular casing 50, a valve member 68 is provided which has a central axially extending stem 72 upon which three discs are mounted. On an outlet end 47 of the valve member 68, a sealing disc 73 is provided which is located in sealed engagement within the outlet end 51 of the tubular casing 50 to close the outlet end 51 against fluid flow inwardly to or outwardly from the pump chamber 71. A radially outwardly extending annular outlet disc 74 is provided on the valve stem 72 axially between the sealing disc 73 and the pump transfer port 58. Axially spaced from the outlet end 47 away from the outlet disc 74, a radially outwardly extending annular inlet disc 75 is provided on the valve stem 42 axially between the pump transfer port 58 and the liquid inlet opening 53 in the inlet end 52 of the tubular casing 50. Each of the outlet disc 74 and the inlet disc 75 have their radial distal ends in engagement with the cylindrical side wall 60 of the tubular casing 50 biased to prevent fluid flow axially of the casing axis 44 of the tubular casing 50 inwardly toward the liquid inlet opening 53, that is, to the right as seen in FIG. 7.

A liquid compartment is defined within the diaphragm liquid pump including as its volume the volume of the diaphragm compartment 70, the transfer port 58 and an annular chamber 81 within the tubular casing 50 about the valve stem 72 in between the outlet disc 74 and the inlet disc 75. In movement of the actuator plate 132 from the extended position of FIG. 7 to the retracted position of FIG. 8, the volume of the diaphragm compartment 70 and thus the liquid compartment decreases thus creating pressure therein which acts on the inlet disc 75 to prevent liquid flow axially therepast to the inlet opening 53 and acts on the outlet disc 74 to deflect the outlet disc 74 to permit liquid flow from the liquid compartment outwardly through the outlet opening 55 to the liquid discharge tube 15 and out the liquid discharge outlet 16. In a retraction stroke in moving from the retracted position of FIG. 8 to the extended position of FIG. 7, due to the inherent resiliency of the diaphragm member 14, the volume of the diaphragm compartment 70 increases as does the volume of the liquid compartment thus creating a vacuum condition which acts on the outlet disc 74 to prevent fluid flow outwardly therepast and acts on the inlet disc 75 to permit liquid to be drawn past the inlet disc 75 through the liquid inlet opening 53 from inside the bottle into the liquid compartment.

In a cycle of operation, in a retraction stroke, liquid is discharged from the liquid compartment through the discharge outlet 82 and, in an extension stroke, liquid is drawn into the liquid compartment through the liquid inlet opening 53.

As seen in FIG. 7, in the assembled pump assembly, the collar axis 48 is normal to the casing axis. The discharge tube 15 is coaxially disposed about the collar axis 48. The diaphragm member 14 is disposed about a collar axis 43 parallel to the collar axis 48 but offset from the collar axis 48.

The combination of the tubular casing 50 and the valve member 68 provides a preferred construction of a one-way inlet valve 46 and a one-way outlet valve 45 which can be manufactured easily and at low cost, preferably from two elements which are injection molded from plastic. The tubular casing 50 is shown to be a cylindrical tube with a cylindrical side wall 60 presenting a cylindrical inner surface about the valve member inlet disc 75 and the outlet disc 74. The side wall 60 need not be cylindrical or of a constant diameter, however, preferably, has a cross-sectional shape which is circular where it is to be engaged by each of the inlet disc 75 or the outlet disc 74. The tubular casing 50 is shown as effectively closed at the inlet end 52 and open at the outlet end 51 which is advantageous to permit the valve member 68 to be inserted axially through the outlet end 51 with the valve member to carry the sealing disc 73 to close the outlet end 51. The tubular casing 50 may be open at the inlet end 52 with the valve member 68 to carry another sealing disc to seal the inlet end 52. The valve member 68 is shown as constrained within the tubular casing 50 against axial movement. The valve member 68 preferably need only carry the inlet disc 75 and the outlet disc 74 and other arrangements can be provided for closing the ends of the tubular casing 50.

In the embodiment of FIGS. 4 to 7, the particular manner by which the diaphragm member 14 is moved between the extended and refracted positions is not limited. One simple arrangement is illustrated in the first embodiment in FIGS. 1 to 8 with the actuator member 132 to engage and compress the diaphragm member 14. However, many other arrangements may be provided to transfer mechanical manual movement by a user and/or movement of an electric motor to move the diaphragm member 14 between the extended and retracted positions. A user could compress the diaphragm member 14 by engaging it with the user's hand.

Figure 9:
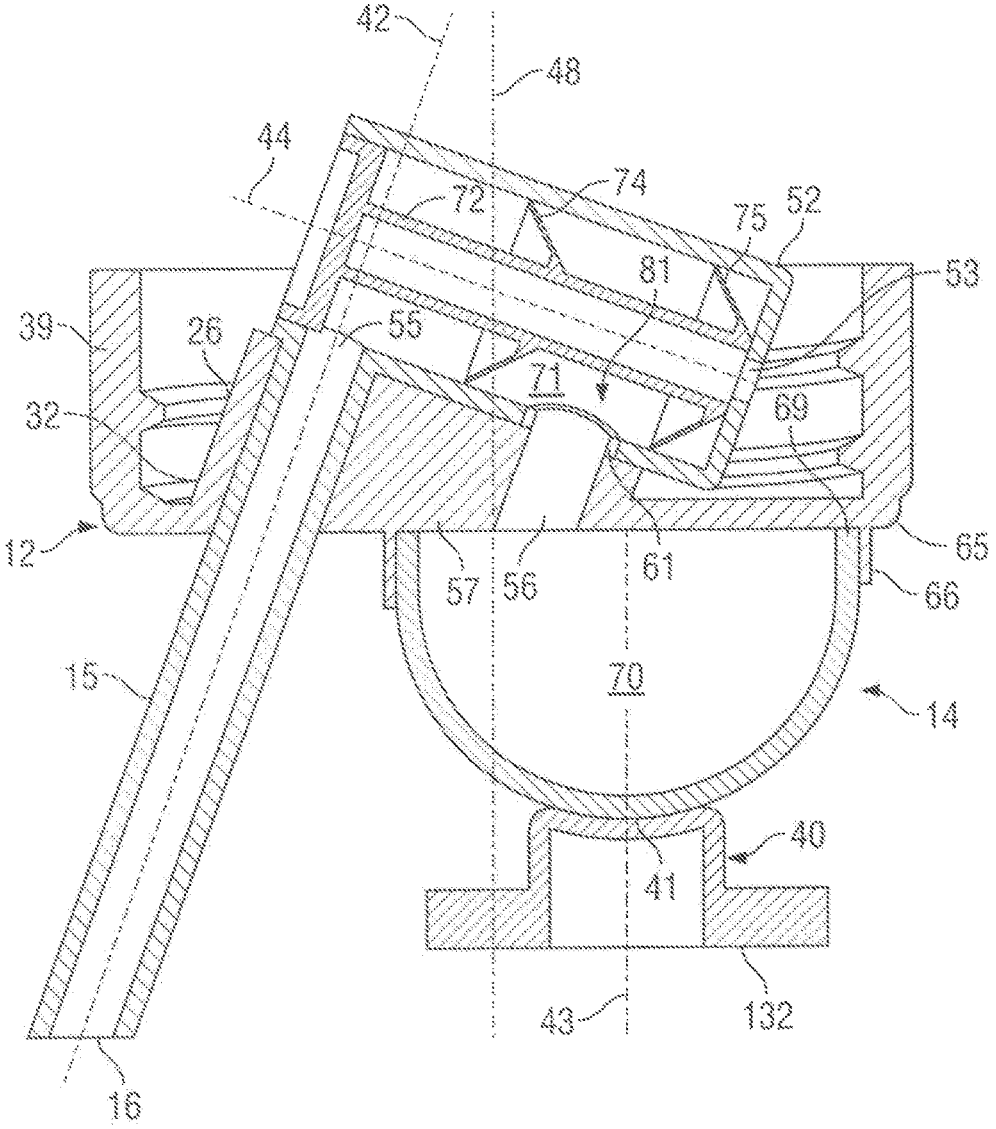
FIG. 9 is a cross-sectional view substantially the same as FIG. 7 but showing a pump assembly in accordance with a second embodiment in accordance with the present invention.

Reference is made to FIG. 9 which illustrates a second embodiment of a diaphragm pump in accordance with the present invention. The second embodiment has close similarities to the first embodiment of FIGS. 4 to 8 and similar reference numerals are used to refer to similar elements. The second embodiment differs from the first embodiment notably in that the tubular casing 50 is mounted to the body 12 such that the casing axis 44 about which the casing 50 is coaxially located is disposed at an angle to a collar axis 48 about which collar 39 of the body 12 is coaxially located. As can be seen, the discharge tube 15 is disposed about a tube axis 42 so as to extend towards the left as seen in FIG. 8 relative to the collar 39 and its collar axis 48. This configuration can be advantageous, for example, so as to provide the discharge tube 15 asymmetrically relative to the collar 39 and, for example, with the discharge tube 15 to extend forwardly of the collar 39 if the pump assembly 10 may be mounted with the left hand side, shown in FIG. 9, as a forward portion of a dispenser and the right hand side, as shown in FIG. 9, as a rear portion of the dispenser. In FIG. 9, the diaphragm member 14 is shown as being displaced towards the left from the collar axis 48, however, the diaphragm member 14 could be reduced in radial size and moved towards the right so as to be disposed coaxially about the collar axis 48, for example, to assist in retrofitting an existing dispenser such that its actuator plate may be disposed as to be centered on the collar axis 48 to readily engage the diaphragm member 14.

In the embodiment as shown in FIG. 9, the diaphragm axis 43, the discharge tube axis 42, the casing axis 44 and the collar axis 39 are provided at selected relative locations and angulations relative to each other. However, the relative locations and angulations of these axes may be different than that illustrated as, for example, to accommodate different configurations of dispensers, actuators and desired direction of discharge.

Providing for arrangements in which the discharge tube 15 may extend, for example, forwardly relative to the collar 39 can be advantageous, for example, in dispensers in which the dispenser might need a requirement of not extending beyond a certain distance from a wall on which the dispenser is mounted as, for example, four inches and providing the discharge outlet 16 further forwardly on the dispenser to increase the space underneath the dispenser that a person's hand to receive the hand cleaning fluid may be spaced from the wall.

FIG. 9 also shows a cylindrical presser element 40 carried on the actuator plate 132 with an upwardly directed concave depression in its upper end 41 to engage the diaphragm member 14 and assist in an advantageous internal collapse of the center of the diaphragm member 12 as the actuator plate 132 is moved upwardly.

Figure 10:
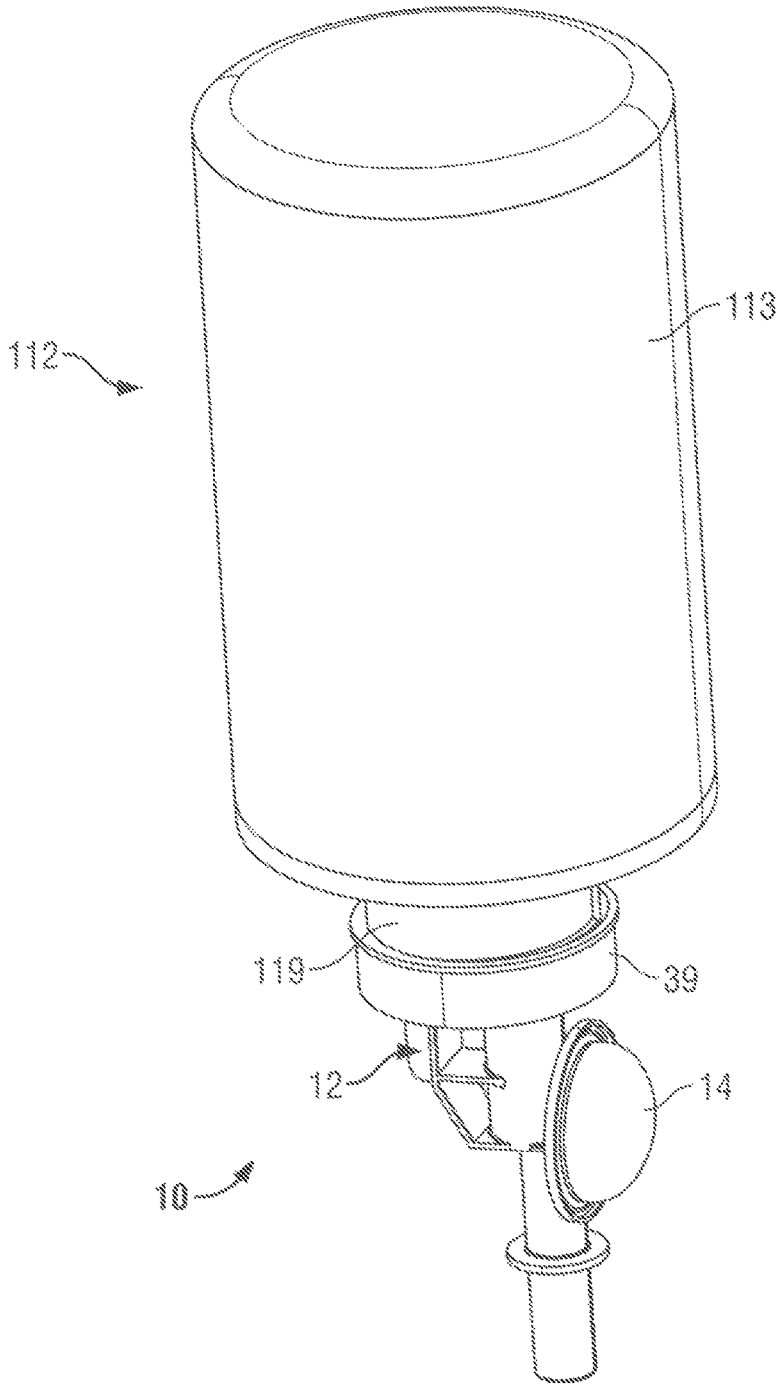
FIG. 10 is a pictorial view of a reservoir cartridge including a pump assembly in accordance with a third embodiment of the present invention.
Figure 11:
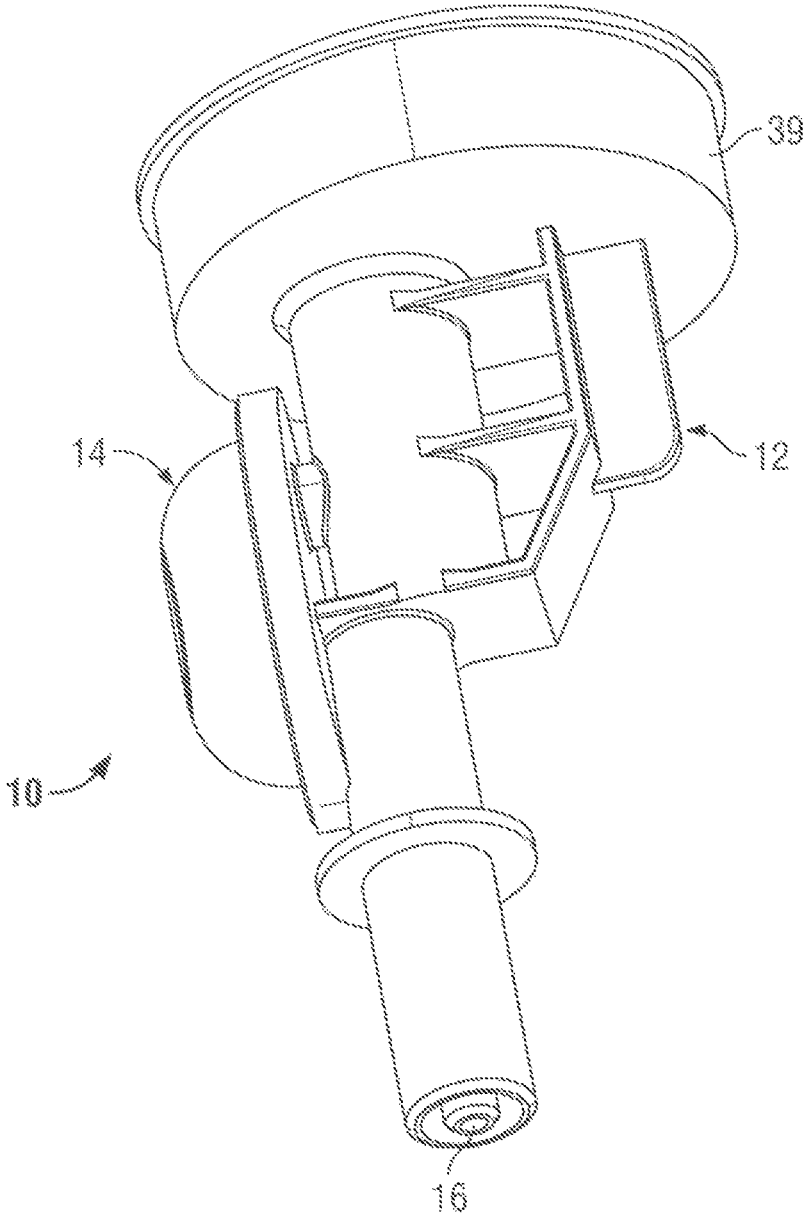
FIG. 11 is a pictorial view of the pump assembly of FIG. 10 in an assembled condition.
Figure 12:
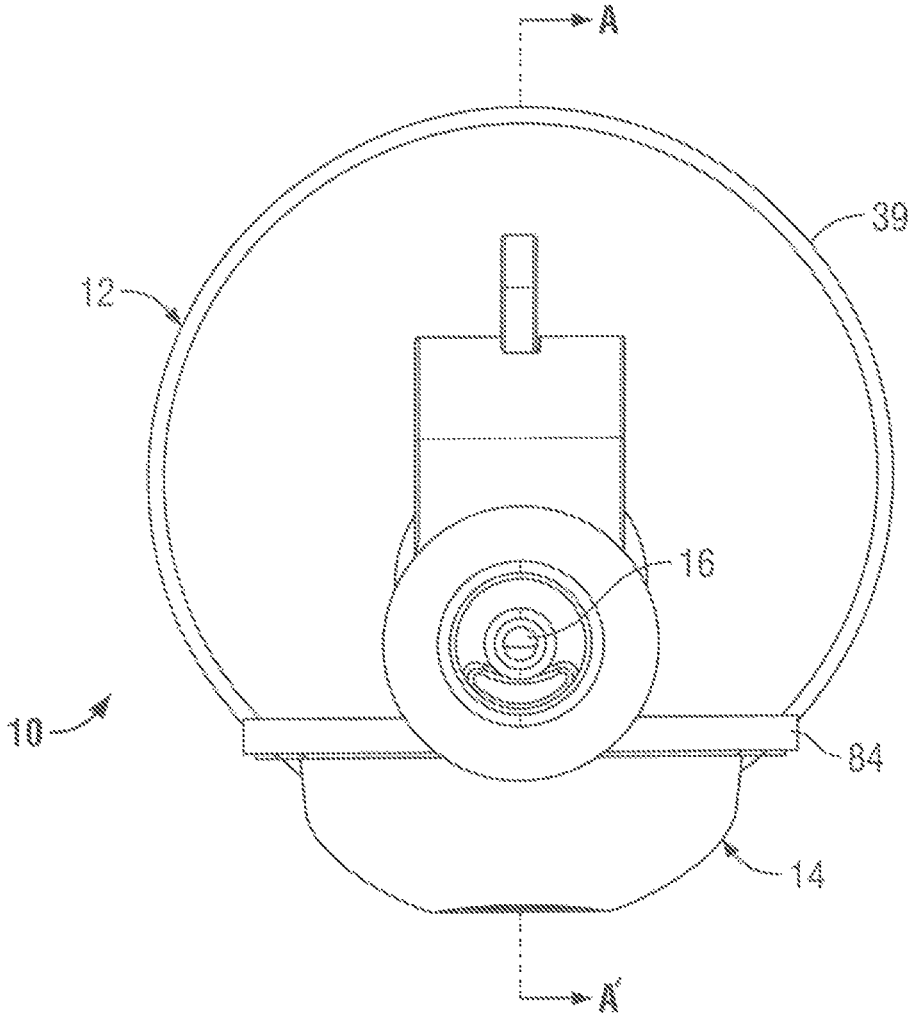
FIG. 12 is a bottom view of the pump assembly of FIG. 11.
Figure 13:
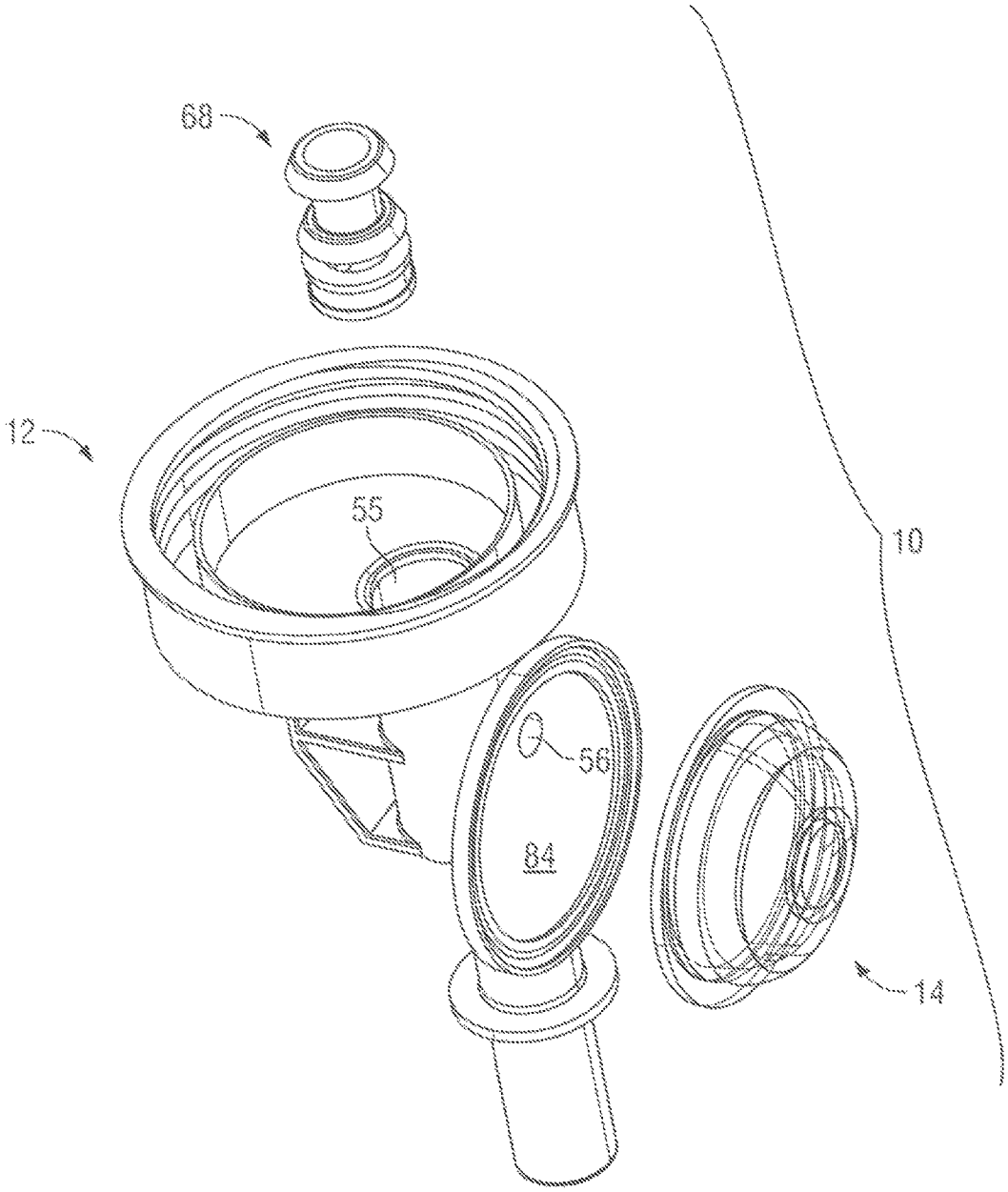
FIG. 13 is an exploded pictorial view of the pump assembly of FIG. 11.

Reference is made to FIGS. 10 to 16 which illustrate a third embodiment of a pump assembly 10 in accordance with the present invention. As with the other embodiments, similar reference numerals are used to refer to similar elements. FIG. 10 illustrates a reservoir cartridge 112 including a bottle 113 whose neck 119 is secured to a collar 39 of the third embodiment of a pump assembly 10. FIG. 11 shows a bottom pictorial view on which the fluid discharge opening 16 can be seen. FIG. 12 illustrates a bottom view of the pump assembly of FIG. 10. FIG. 13 is an exploded pictorial view of the pump assembly of FIG. 11 and illustrates the pump assembly 10 as comprising three elements, namely, a body 12, a valve member 68 and a diaphragm member 14, each of which is preferably injection molded as a unitary element such that the pump assembly 10 may preferably comprise but three elements, although this is not necessary. The valve member 68 is best seen in an enlarged pictorial view on FIG. 14.

Figure 15:
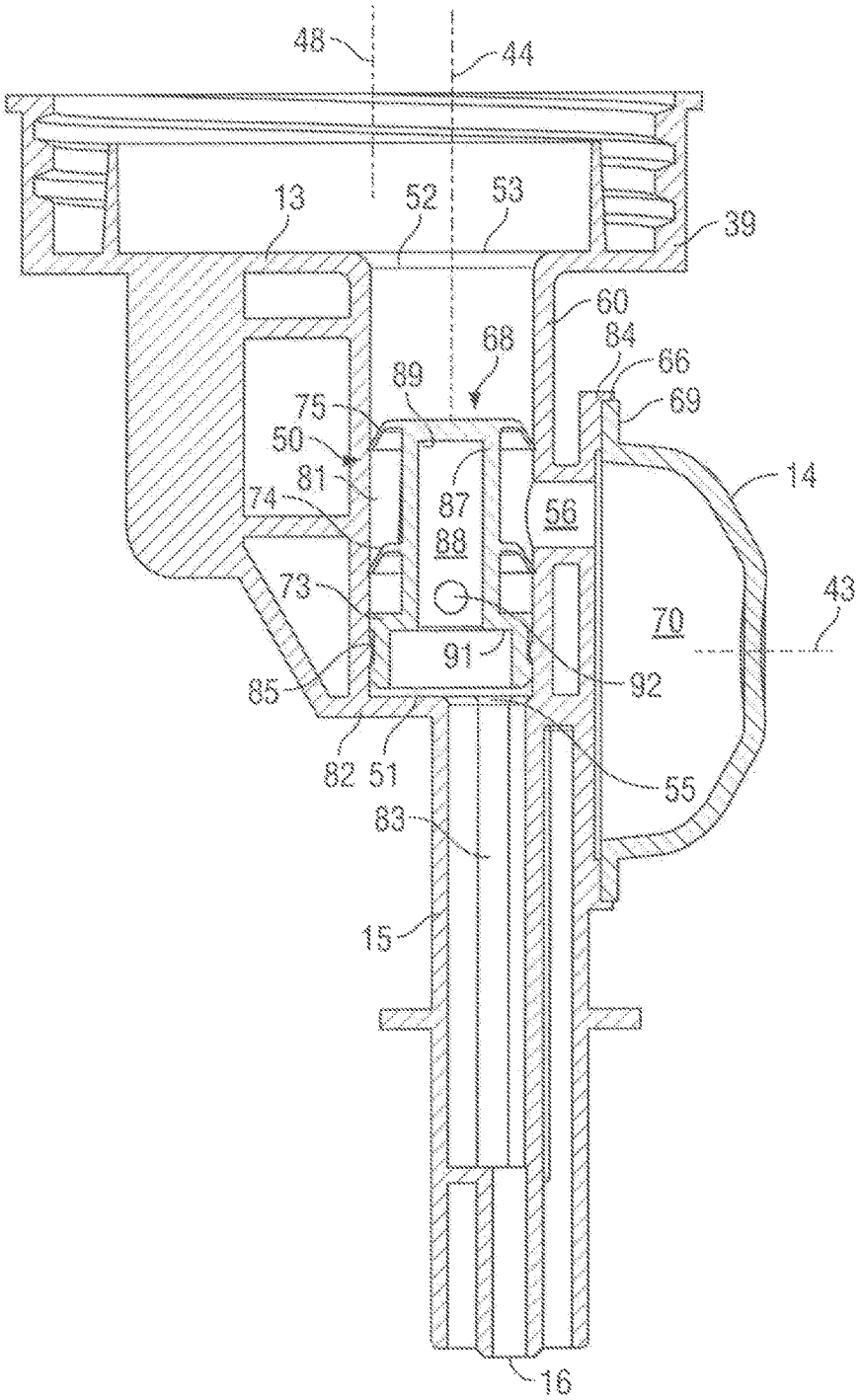
FIG. 15 is a cross-sectional side view of the pump assembly of FIG. 11 along section line A-A' in FIG. 12.
Figure 16:
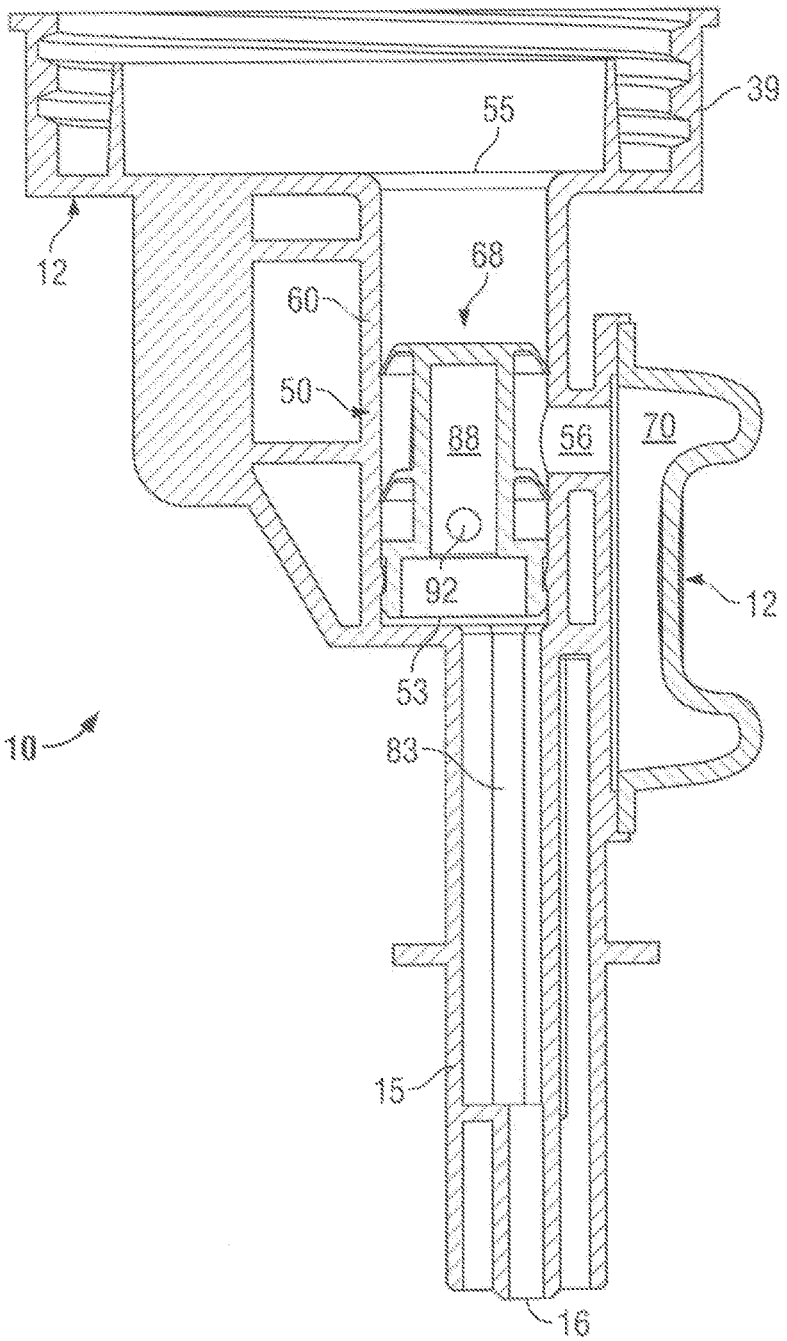
FIG. 16 is a cross-sectional side view the same as FIG. 14, however, showing the diaphragm in a compressed condition as compressed by a plunger member.

Referring to the cross-sectional side view of FIG. 15, the body 12 includes an annular collar 39 closed at an outer end by a base 13. The collar 39 is coaxially disposed about the collar axis 48 and the base 13 is shown as a circular plate disposed normal to the collar axis. A liquid inlet opening 53 extends through the base 13 and provides an open inlet end 52 to a cylindrical casing 50 disposed about a casing axis 44 parallel to the collar axis 48. The cylindrical casing 50 has a first end 51 including an outlet end wall 82 through which an outlet opening 55 extends opening into a discharge passageway 83 through a liquid discharge tube 15 to a liquid discharge outlet 16. A transfer port 56 is provided through a side wall 60 of the cylindrical casing 50 into communication with a variable volume diaphragm compartment 70. A circular base 84 for a diaphragm pump 85 is mounted to be disposed in a plane that extends parallel to the casing axis 48 as secured to a side of the casing 50 and the discharge tube 15. The base 84 has a cylindrical flange 66 to which an annular periphery 69 of the diaphragm member 14 is secured in a sealed arrangement. The tubular casing 50 is shown to have the cylindrical side wall 60 disposed about the casing axis 44. Proximate the outlet end 51 of the casing, an annular catch rib 85 extends radially inwardly.

Figure 14:
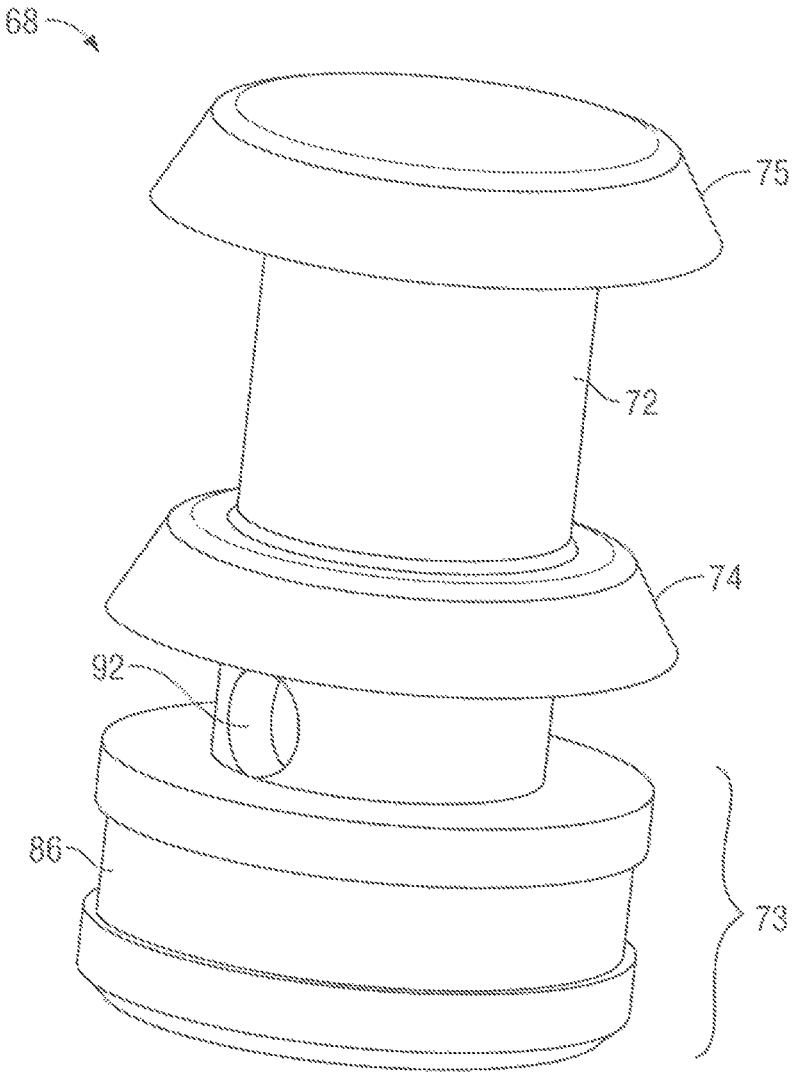
FIG. 14 is an enlarged pictorial view of a valve member shown in FIG. 13.

The valve member 68 is best seen in the enlarged pictorial view of FIG. 14 as including a central axis extending stem 72 upon which three discs are mounted including a sealing disc 73, an outlet disc 74 and an inlet disc 75. The sealing disc 73 is provided with an annular catch groove 86. On insertion of the valve member 68 into the cylindrical casing 50, the valve member 68 is urged axially outwardly such that the catch groove 86 in the sealing disc 73 engages upon the catch rib 85 of the cylindrical casing 50 so as to locate the valve member 68 within the cylindrical casing 50 against relative axial movement and against removal.

The stem 72 is hollow, has a tubular stem wall 84 and defines radially within the stem wall 87 a discharge passage 88 closed at an inner end 89 and open at an outer end 91 to the discharge passageway 83. A discharge port 92 is provided through the stem wall 87 in between the outlet disc 74 and the sealing disc 73. An annular chamber 81 is defined within the tubular casing 50 annularly about the valve stem 72 in between the outlet disc 74 and the inlet disc 75. Each of the inlet disc 75, the outlet disc 74 and the sealing disc 73 interact with the cylindrical casing 50 in a substantially identical manner to that described with the first embodiment. On urging the diaphragm member 14 inwardly to reduce the volume of the variable volume of diaphragm compartment 70, pressure is created within the variable volume diaphragm compartment 70, the transfer port 56 and the annular chamber 81 which acts on the inlet disc 75 to prevent fluid flow axially therepast to the inlet opening 53 and acts on the outlet disc 74 to deflect the outlet disc 74 to permit fluid flow from the annular chamber 81 outwardly through the discharge port 92 into the discharge passage 88 and hence to the outlet opening 55 through the liquid discharge tube 15 and out the liquid discharge outlet 16. On the diaphragm member 14 moving outwardly to increase the volume of the variable volume diaphragm compartment 70, a vacuum is created within the annular chamber 81 which acts on the outlet disc 74 to prevent fluid flow outwardly therepast and acts on the inlet disc 75 to permit liquid to be drawn past the liquid disc 75 through the inlet opening 53 from inside a bottle into the annular chamber 81.

The third embodiment of FIGS. 10 to 15 has a configuration in which the cylindrical casing 50 is disposed about the casing axis 44 parallel to the collar axis 48 and the diaphragm member 14 is disposed about a diaphragm axis 43 arranged so as to be displaced by movement of the diaphragm member 14 radially relative to the collar axis 48. The inlet opening 53 is disposed in a lowermost portion of the collar 39, that is, in the base 13 as is advantageous so as to provide for pumping of virtually all of the liquid within a bottle out of the bottle.

Figure 17:
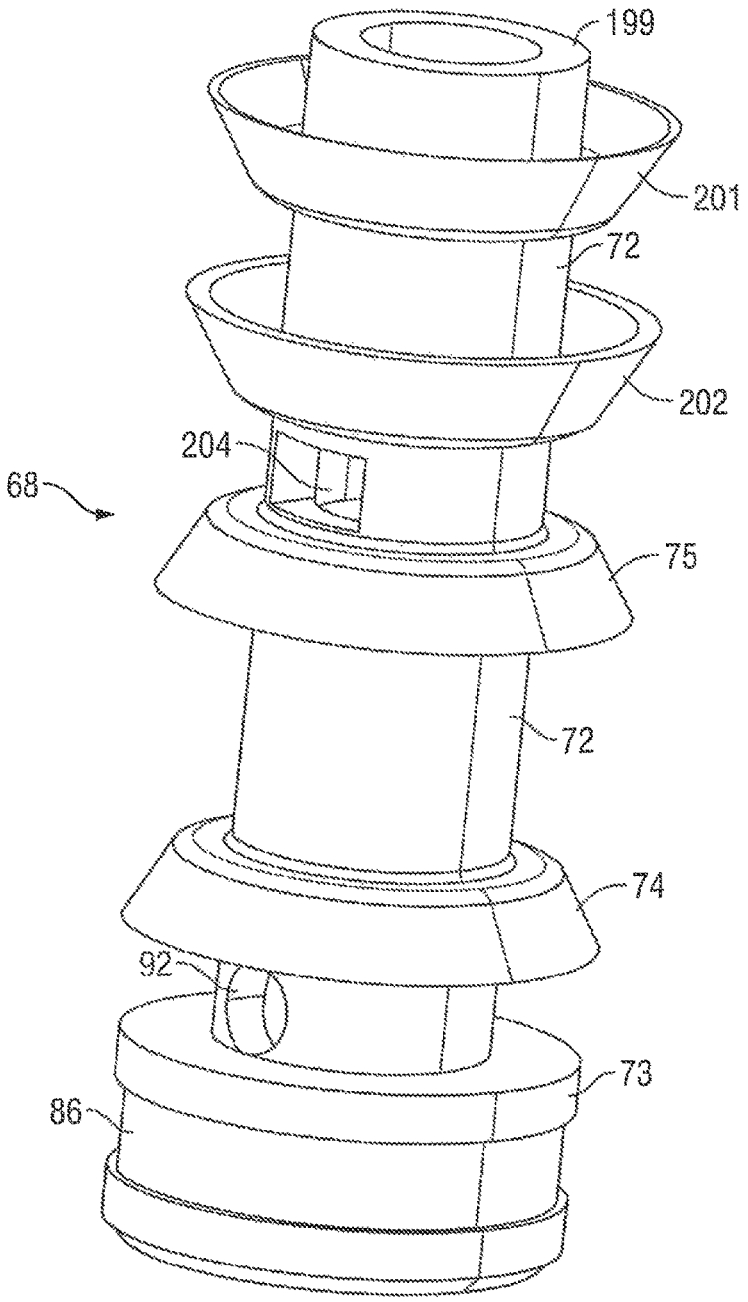
FIG. 17 is a pictorial view showing an alternate embodiment of a valve member in accordance with the present invention.
Figure 18:
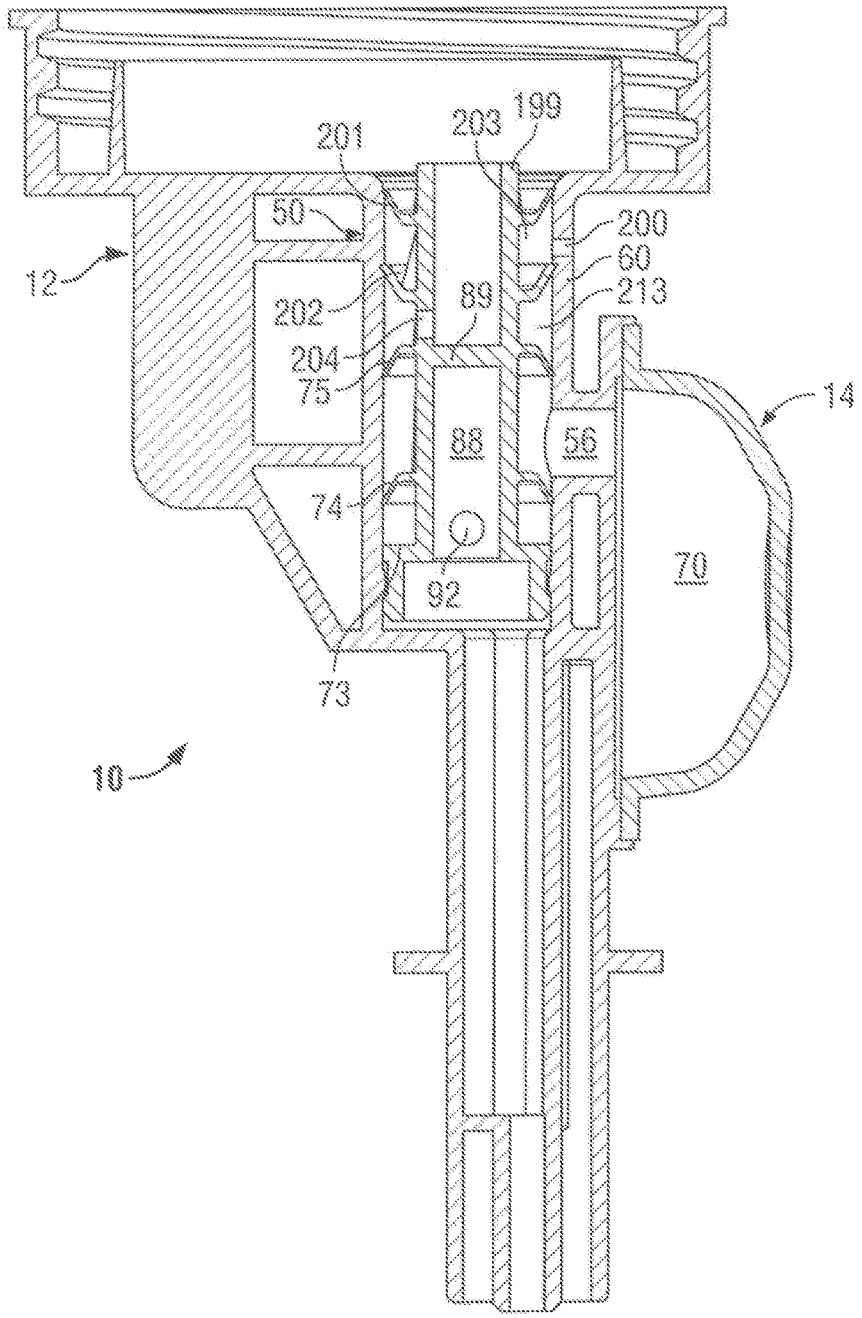
FIG. 18 is a cross-sectional side view the same as FIG. 15 but with the valve member of FIG. 17 showing a fourth embodiment of a pump assembly in accordance with the present invention.

Reference is made to FIGS. 17 and 18 which illustrate a fourth embodiment of a pump assembly 10 in accordance with the present invention. The pump assembly 10 of the fourth embodiment as shown in FIG. 18 is identical to the pump assembly 10 of the third embodiment as shown in FIG. 15 but for a modification of the body 12 so as to provide an air vent port 200 through the side wall 60 of the cylindrical casing 50 and modifications of the valve member 68 so as to extend the stem 72 axially inwardly to an inner end 199; to provide two additional discs on the stem inwardly of the inner disc, namely, an air seal disc 202 and an air vent disc 201, and to add a liquid inlet port 204 through the wall 60 between the air seal disc 202 and the inlet disc 75 to permit fluid flow from the bottle inside the stem 72 to an annular chamber 213 between the air seal disc 202 and the inlet disc 75. The air seal disc 202 is spaced axially inwardly from the inlet disc 75. The air vent disc 201 is spaced axially inwardly from the air seal disc 202. Each of the air seal disc 202 and the air vent disc 201 extend radially outwardly from the valve stem 72 to have their radial distal ends in engagement with the cylindrical side wall 60 of the tubular casing 50 biased to prevent fluid flow axially of the tubular casing 50 outwardly, that is, towards the inlet disc 75. The valve member 68 when secured in the cylindrical casing 50 has the air vent port 200 disposed axially between the air seal disc 202 and the air vent disc 201. Insofar as the pump assembly 10 is used with the bottle 113 which is not collapsible, with dispensing of fluid from the bottle, a vacuum condition may be created within the bottle 113 which will resist or prevent fluid being drawn from the bottle. When a sufficient vacuum condition exists within the bottle, that is, axially inwardly of the air vent disc 201, the vacuum acts on the air vent disc 201 to displace the air vent disc 201 from engagement with the cylindrical side wall 60 of the tubular casing 50 and permit air flow from the atmosphere through the air vent port 200 into the bottle to relieve the bottle.

An annular air vent chamber 203 is defined about the stem 72 in between the air vent disc and the air seal disc 202 open to the atmosphere via the air vent port 200. The air seal disc 202 prevents atmospheric air from passing axially outwardly past the air vent disc 201. This arrangement of venting of atmospheric air into the bottle is useful when the bottle is not collapsible in the sense that the vacuum conditions may exist within the bottle during discharge of fluid. Such an air vent is typically not required when a collapsible bottle may be utilized.

Figure 19:
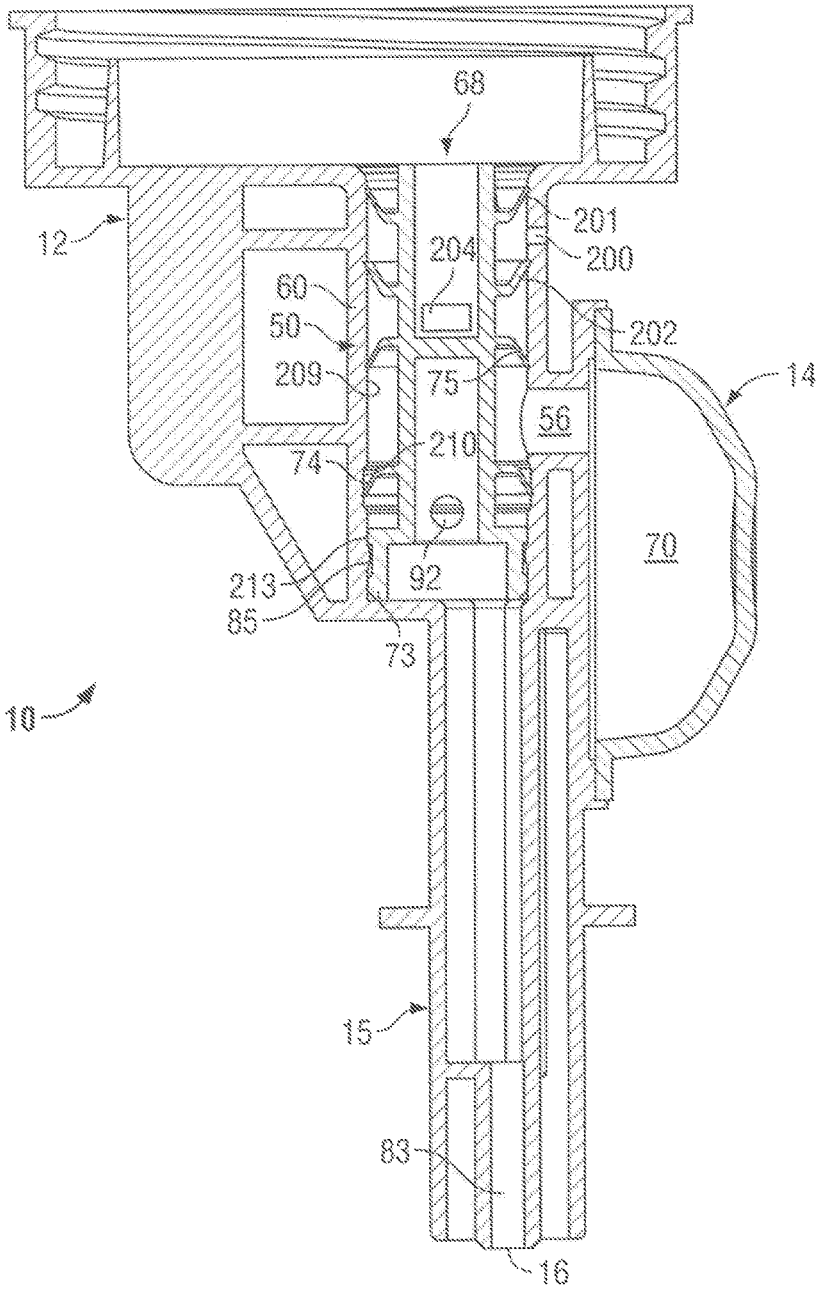
FIG. 19 is a cross-sectional side view similar to FIG. 18 showing a fifth embodiment of a pump assembly in accordance with the present invention with the valve member in a refracted condition.
Figure 20:
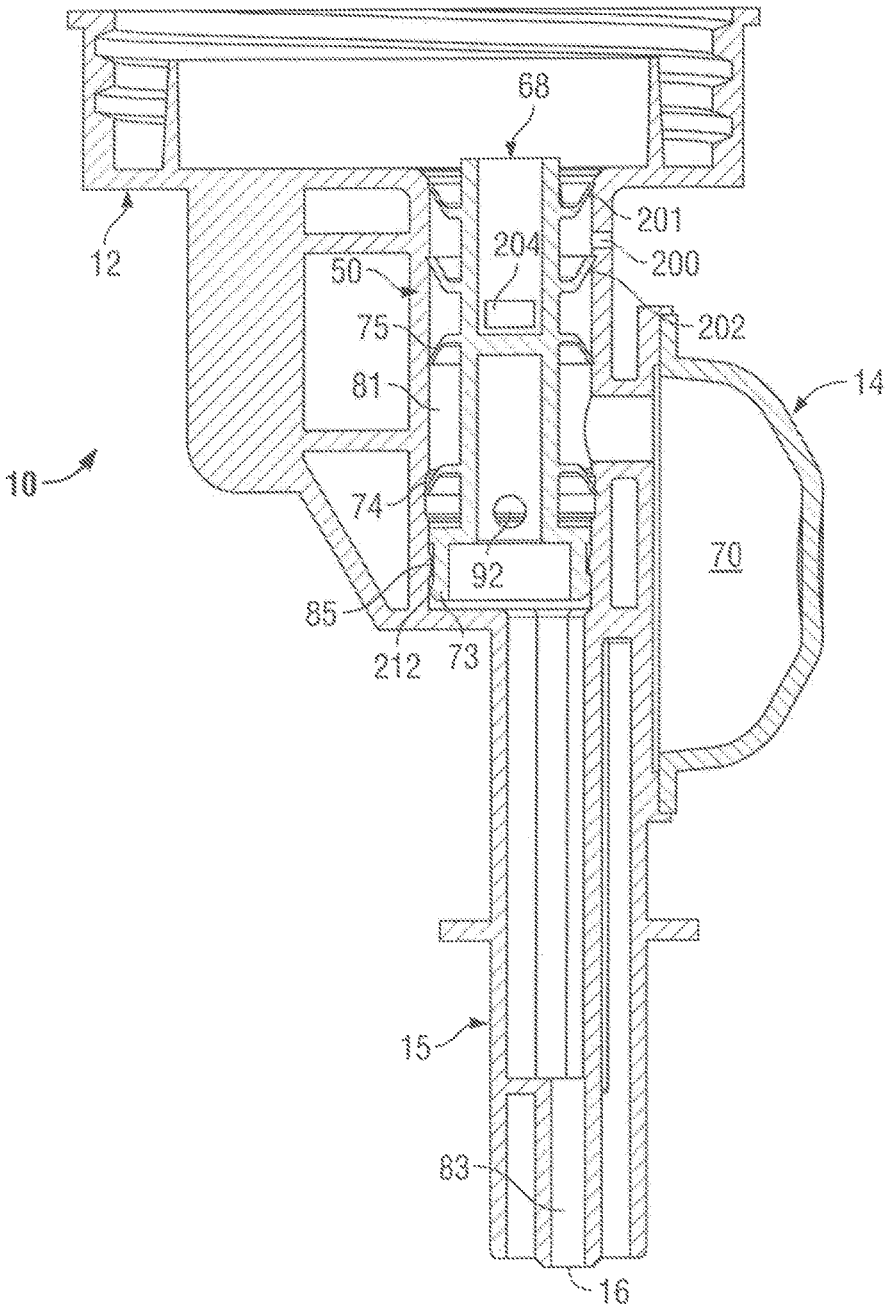
FIG. 20 is a cross-sectional view the same as FIG. 19 but with the valve member in an extended condition.

Reference is made to FIGS. 19 and 20 which illustrate a fifth embodiment of a pump assembly 10 in accordance with the present invention. The pump assembly 10 of the fifth embodiment of FIGS. 19 and 20 is identical to the pump assembly 10 in the fourth embodiment as shown in FIG. 18, however, with two exceptions. A first exception is that the cylindrical side wall 60 of the casing 50 is stepped in that it includes an outer portion 210 of an enlarged diameter compared to the diameter of an inner portion 209. The outer portion 210 is axially located within the cylindrical casing 50 such that the outlet disc 74 is at all times disposed within the enlarged diameter outer portion 210. A second exception is that the annular rib 85 on the casing 50 has a reduced axial extent so as to permit the valve member 68 to be axially slidable relative to the casing 50 between an extended and axially outer position as seen in FIG. 19 and a retracted axially inner position as seen in FIG. 20. As can be seen in FIG. 20, the annular rib 85 is engaged on an axially inwardly directed shoulder 212 of the catch groove 86 on the sealing disc 73 whereas in FIG. 19, an axially inwardly directed shoulder of the annular rib 85 is engaged on an axially outwardly directed shoulder 213 of the catch groove 86. The valve member 68 is axially movable between the extended position of FIG. 19 and the retracted position of FIG. 20. In a cycle of operation, during a discharge stroke in which pressure within the variable volume compartment 70 deflects the outlet disc 74 to discharge fluid therepast, the pressure differential across the outlet disc 74 will act on the outlet disc 74 to force the valve member 68 axially outwardly to the extended position as seen in FIG. 19. As the diaphragm member 14 moves so as to create a vacuum within the variable volume diaphragm compartment 70, before the vacuum is sufficiently great to deflect the inlet disc 75 and draw fluid inwardly past the inlet disc 75, the vacuum condition will attempt to reduce the volume in the annular chamber 81 between the inlet disc 75 and the outlet disc 74 with such vacuum drawing the valve member 68 axially outwardly from the extended position of FIG. 19 to the retracted condition of FIG. 20 since the outer disc 74 is received within the larger diameter outer portion 210 having a greater diameter than the smaller diameter inner portion 209 within which the inlet disc 75 is received. With axial movement of the valve member 68 axially inwardly, the volume within the annular chamber 81 between the inlet disc 75 and the outlet disc 74 decreases. The movement of the valve member 68 from the extended position of FIG. 19 to the retracted position of FIG. 20 draws fluid within the discharge passageway 83 back from the discharge outlet 16 into the casing 50 as can be advantageous to assist in preventing fluid from dripping out of the discharge outlet 16 after a stroke of operation when the pump assembly is at rest and not in use.

Figure 21:
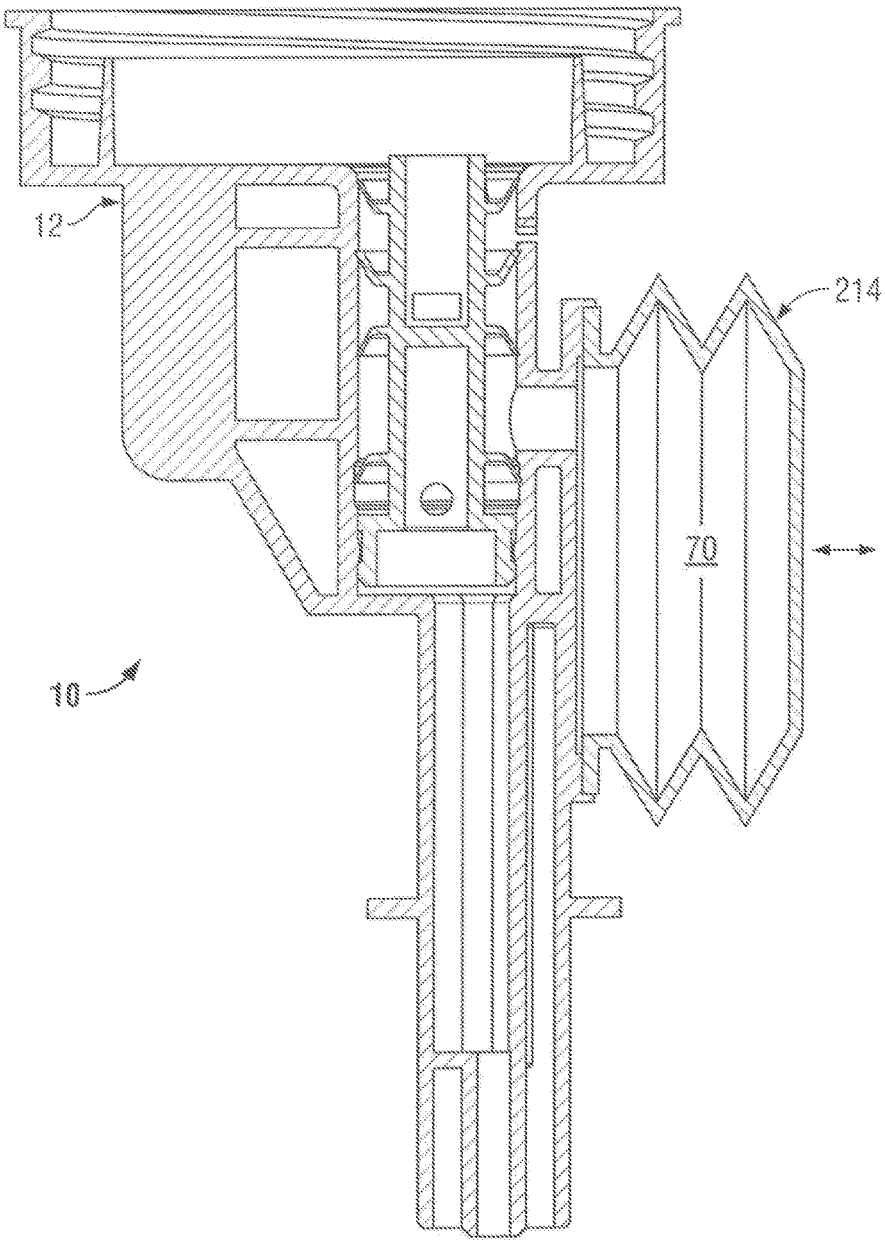
FIG. 21 is a cross-sectional view similar to FIG. 15 but with a bellows member.

Reference is made to FIG. 21 which illustrates a sixth embodiment of a pump assembly 10 in accordance with the present invention identical to that as illustrated in the embodiment of FIG. 19, however, in which the diaphragm member 14 has been replaced by a bellows member 214 defining the enclosed variable volume compartment 70 with the bellows member 214 adapted to be moved, for example, radially or tipped at an angle so as to change the volume of the variable volume compartment 70.

Figure 22:
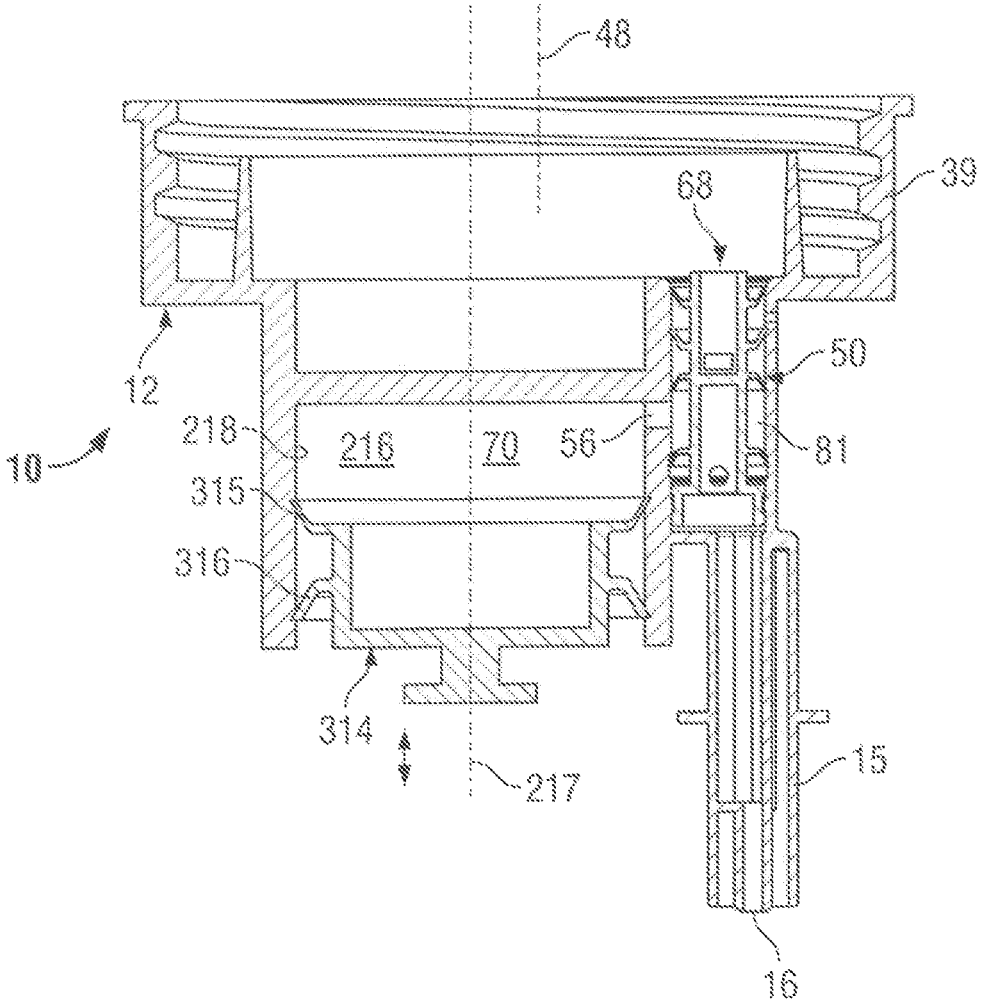
FIG. 22 is a cross-sectional view similar to FIG. 15 but with a piston member.

Reference is made to FIG. 22 which shows a pump assembly 10 in accordance with a seventh embodiment of the present invention similar to that illustrated in the embodiment of FIG. 19, however, in which the body 12 is modified as to provide a piston chamber 216 disposed about a piston axis 217 parallel to the collar axis 48 and in which a piston member 314 is coaxially reciprocally slidable. The piston member 314 carries sealing discs 315 and 316 to engage a cylindrical side wall 218 of the piston chamber 216 and to together prevent fluid flow inwardly or outwardly therepast. Between the piston chamber 216 and the piston member 314, there is formed a variable volume compartment 70 which is open via a transfer port 56 into an annular chamber 81 defined within the cylindrical casing 50 about the valve member 68 between the inlet disc 75 and the outlet disc 74. With reciprocal movement of the piston member 314, the volume of the variable volume compartment 70 changes and fluid is drawn from the bottle and discharged out the discharge outlet 16 as with the other embodiments. While the embodiment of FIG. 22 illustrates the piston chamber 216 as extending along the piston axis 217 parallel to the collar axis 48 and the axis of the cylindrical casing 50, this is not necessary and the piston axis 217 may be disposed at any advantageous axis as, for example, to extend radially of the collar axis 48 or at some angle thereto.

Pump assemblies 10 in accordance with the present invention have a preferred use for dispensing hand cleaning fluids and other materials onto the hand of the user. The pump assemblies are, however, not so limited. The liquid dispensed by the pump assemblies 10 may be for any manner of uses. For example, rather than cleaning a person's hand, the matter dispensed may be useful for other purposes such as providing conditioning creams or other treatment for application to a person. The dispenser for dispensing both liquid and solid material are useful for many industrial applications, such as in dispensing foods and confectionaries.

While the invention has been described with reference to preferred embodiments, many variations and modifications will occur to a person skilled in the art. For definition of the invention, reference is made to the following claims.

We claim:

1. A pump comprising:

a variable volume compartment defined between a chamber-forming body and a movable member movable relative to the chamber-forming body wherein movement of the movable member changes a volume of the variable volume compartment between a first volume and a second volume different than the first volume, a tubular valve casing elongate along a casing axis, defining a valve chamber therein, the valve chamber having an inner wall circular in cross-section along the axis, an open inlet end and an outlet end, the inlet end to be placed into communication with an interior of an enclosed non-collapsible reservoir containing a fluid to be dispensed, a valve member coaxially located within the valve chamber, the valve member comprising a stem extending axially within the valve chamber, an inlet disc extending radially outwardly from the stem to a distal end in engagement with the inner wall, the inlet disc engaging the inner wall to prevent fluid flow axially therepast in a direction from the outlet end towards the inlet end, the inlet disc being resiliently deflectable to be deflected from engaging the inner wall to permit fluid flow axially therepast in a direction from the inlet end towards the outlet end, an outlet disc extending radially outwardly from the stem to a distal end in engagement with the inner wall, the outlet disc engaging the inner wall to prevent fluid flow axially therepast in a direction from the outlet end towards the inlet end, the outlet disc being resiliently deflectable to be deflected from engaging the inner wall to permit fluid flow axially therepast in a direction from the inlet end towards the outlet end, the inlet disc on the stem spaced axially away from the outlet end from the outlet disc, the outlet disc on the stem spaced axially away from the inlet end from the inlet disc, an outlet from the valve chamber spaced axially away from the inlet end from the outlet disc, the outlet in communication with a liquid discharge outlet, a fluid transfer port in communication with the variable volume compartment and open through the inner wall into the valve chamber in between the inlet disc and the outlet disc, an air seal disc extending radially outwardly from the stem to a distal end in engagement with the inner wall, the air seal disc engaging the inner wall to prevent fluid flow axially therepast in a direction from the inlet end towards the outlet end, the air seal disc spaced axially away from the outlet end from the inlet disc, an air vent disc extending radially outwardly from the stem to a distal end in engagement with the inner wall, the air vent disc engaging the inner wall to prevent fluid flow axially therepast in a direction from the inlet end towards the outlet end, the air vent disc being resiliently deflectable to be deflected from engaging the inner wall to permit fluid flow axially therepast in a direction from the outlet end towards the inlet end, the air vent disc spaced axially away from the outlet end from the air seal disc, an air vent port through the inner wall opening the valve chamber to the atmosphere, the air vent port on the stem axially between the air seal disc and the air vent disc, the stem having a tubular stem wall, the stem wall defining radially within the stem wall a discharge passage closed at an inner end and open at an outer end in communication with the outlet, the stem wall defining radially within the stem wall a feed passage open at an inner end in communication with the inlet end and closed at an outer end, a liquid inlet port through the stem wall into the feed passage in between the air seal disc and the inlet disc.

2. A pump as claimed in claim 1 wherein the valve member is fixed to the chamber-forming body against relative movement.

3. A pump as claimed in claim 1 wherein the valve casing and the chamber-forming body are injection molded as a unitary element.

4. A pump as claimed in claim 1 wherein:

when a vacuum condition exists at the inlet end sufficient to act on the air vent disc to deflect the air vent disc from engaging the inner wall, air from the atmosphere is drawn inwardly past the air vent disc to reduce the vacuum condition with the air from the atmosphere passing via the air vent port into the valve chamber between the air seal disc and the air vent disc annularly about the stem and past the air vent disc to the inlet end.

5. A pump as claimed in claim 1 wherein the valve casing is open at the outlet end to provide the outlet, the valve stem carrying a sealing disc which engages the valve casing outwardly of the outlet disc to close the outlet end of valve chamber, a liquid discharge port through the stem wall into the discharge passage in between the outlet disc and the sealing disc.

6. A pump as claimed in claim 5 wherein:

the sealing disc extending radially outwardly from the stem to a distal end in engagement with the inner wall, the sealing disc engaging the inner wall to prevent fluid flow axially therepast in a direction from the inlet end towards the outlet end.

7. A pump as claimed in claim 5 wherein the sealing disc engages the valve casing to secure the valve casing in valve chamber against removal.

8. A pump as claimed in claim 5 wherein:

movement of the movable member to increase the volume of the variable volume compartment draws the fluid from the interior of the reservoir into the variable volume compartment through the valve chamber via the inner end of the feed passage, the feed passage and the liquid inlet port to between the air seal disc and the inlet disc and then via the fluid transfer port to the variable volume compartment creating a vacuum within the valve chamber between the inlet disc and the outlet disc which vacuum acts on the inlet disc to deflect the inlet disc from engaging the inner wall permitting the fluid to be drawn inwardly from the inlet past the inlet disc, movement of the movable member to decrease the volume of the variable volume compartment discharges the fluid from the variable volume compartment through the valve chamber to the discharge outlet via the fluid transfer port to between the inlet disc and the outlet disc and then past the outlet disc to between the outlet disc and the sealing disc and via the liquid discharge port into the discharge passage to the outlet creating pressure within the valve chamber between the inlet disc and the outlet disc which pressure acts on the outlet disc to deflect the outlet disc from engaging the inner wall permitting the fluid to be discharged outwardly past the outlet disc to the outlet.

9. A pump as claimed in claim 5 wherein:

when a vacuum condition exists at the inlet end sufficient to act on the air vent disc to deflect the air vent disc from engaging the inner wall, air from the atmosphere is drawn inwardly past the air vent disc to reduce the vacuum condition with the air from the atmosphere passing via the air vent port into the valve chamber between the air seal disc and the air vent disc annularly about the stem and past the air vent disc to the inlet end.

10. A pump as claimed in claim 1 wherein:

movement of the movable member to increase the volume of the variable volume compartment draws the fluid from the interior of the reservoir into the variable volume compartment through the valve chamber via the inner end of the feed passage, the feed passage and the liquid inlet port to between the air seal disc and the inlet disc, past the inlet disc and then via the fluid transfer port to the variable volume compartment creating a vacuum within the valve chamber between the inlet disc and the outlet disc which vacuum acts on the inlet disc to deflect the inlet disc from engaging the inner wall permitting the fluid to be drawn inwardly past the inlet disc, movement of the movable member to decrease the volume of the variable volume compartment discharges the fluid from the variable volume compartment through the valve chamber to the discharge outlet via the fluid transfer port to between the inlet disc and the outlet disc and then past the outlet disc, into the discharge passage to the outlet creating pressure within the valve chamber between the inlet disc and the outlet disc which pressure acts on the outlet disc to deflect the outlet disc from engaging the inner wall permitting the fluid to be discharged outwardly past the outlet disc to the outlet.

11. A pump as claimed in claim 10 wherein with the discharge of fluid from the reservoir a vacuum condition created within the interior of the reservoir is relieved by air from the atmosphere being drawn into the interior of the reservoir via the air vent port into the valve chamber between the air seal disc and the air vent disc annularly about the stem and past the air vent disc to the inlet end of the valve member into the interior of the reservoir, when the vacuum condition created within the interior of the reservoir is sufficient to act on the air vent disc to deflect the air vent disc from engaging the inner wall permitting the air fluid to be drawn inwardly past the air vent disc.

12. A pump as claimed in claim 10 wherein the valve member is injection molded as a unitary element.

13. A pump as claimed in claim 12 wherein the valve casing is injection molded as a unitary element.

14. A pump as claimed in claim 10 wherein:

when a vacuum condition exists at the inlet end sufficient to act on the air vent disc to deflect the air vent disc from engaging the inner wall, air from the atmosphere is drawn inwardly past the air vent disc to reduce the vacuum condition with the air from the atmosphere passing via the air vent port into the valve chamber between the air seal disc and the air vent disc annularly about the stem and past the air vent disc to the inlet end.

15. A pump as claimed in claim 14 wherein:

the movable member comprises a diaphragm member sealably engaged to the chamber-forming body forming the variable volume compartment therebetween enclosed but for the transfer port, the diaphragm member, when coupled to the chamber-forming body, is deflectable between conditions including a first configuration defining the variable volume compartment to have the first volume and a second configuration defining the variable volume compartment to have the second volume;

the diaphragm member being a resilient deflectable member with an inherent bias to assume an inherent unbiased condition and when deflected from the unbiased condition to return toward the unbiased condition; and the inherent bias urges the diaphragm member to assume one of the first configuration and the second condition.

16. A pump as claimed in claim 14 wherein:

the movable member comprises a bellows member sealably engaged to the chamber-forming body forming the variable volume compartment therebetween enclosed but for the transfer port.

17. A pump as claimed in claim 14 wherein:

the chamber-forming body forms a piston chamber disposed about an axis and having an open end and a closed end, the movable member comprises a piston member coaxially reciprocally slidable within the piston chamber sealably engaged with the piston chamber to define the variable volume compartment within the piston chamber between the piston member and the closed end, the variable volume compartment enclosed but for the transfer port.

18. A pump as claimed in claim 14 wherein:

the valve member is coupled to the chamber-forming body to permit limited relative axial movement between an axially outer position closer to the outlet end and an axially inner position farther from the outlet end, the inlet disc engaging the inner wall over a first portion of the inner wall having a first diameter, the outlet disc engaging the inner wall over a second portion of the inner wall having a second diameter less than the first diameter, wherein during movement of the movable member to change the volume of the variable volume compartment to decrease and create the pressure, the pressure forces the valve member to the axially outer position, wherein during movement of the movable member to of the variable volume compartment to increase and decrease the vacuum, the vacuum draws the valve member to the axially inner position, and wherein with movement of the valve member from the axially outer position to the axially inner position fluid between the outlet end and the discharge outlet is drawn back from the discharge outlet toward the outlet end.

19. A pump as claimed in claim 14 wherein the valve member is fixed to the chamber-forming body against relative movement.

* * * * *